US005844534A

United States Patent [19]

Okumura et al.

[11] Patent Number: 5,844,534

[45] Date of Patent: Dec. 1, 1998

[54] LIQUID CRYSTAL DISPLAY APPARATUS

[75] Inventors: Haruhiko Okumura, Kawasaki; Hisao Fujiwara, Yokohama; Go Ito, Tokyo, all of Japan

[73] Assignee: Kabushiki Kaisha Toshiba, Kawasaki, Japan

[21] Appl. No.: 365,249

[22] Filed: Dec. 28, 1994

[30] Foreign Application Priority Data

Dec. 28, 1993 [JP] Japan ..... 5-349339
Sep. 17, 1994 [JP] Japan ..... 6-248460

[51] Int. Cl.[6] ..... G09G 3/36

[52] U.S. Cl. ..... 345/90; 345/100; 345/103; 345/127

[58] Field of Search ..... 345/30, 55, 87, 345/90–100, 103, 112, 121, 204, 208, 68, 166, 173, 178, 127; 348/739, 790, 792, 793; 359/36, 54–59, 84, 85

[56] References Cited

U.S. PATENT DOCUMENTS

| | | | |
|---|---|---|---|
| 4,386,351 | 5/1983 | Lowdenslager | 345/56 |
| 4,694,348 | 9/1987 | Kamiya et al. | 348/793 |
| 5,136,282 | 8/1992 | Inaba et al. | 345/97 |
| 5,172,107 | 12/1992 | Kanno et al. | 345/100 |
| 5,172,108 | 12/1992 | Wakabayashi et al. | 345/148 |
| 5,223,824 | 6/1993 | Takeda et al. | 345/93 |
| 5,252,959 | 10/1993 | Kono | 345/147 |
| 5,398,043 | 3/1995 | Takeda et al. | 345/94 |
| 5,412,397 | 5/1995 | Kanatani et al. | 345/99 |
| 5,546,104 | 8/1996 | Kuga | 345/125 |
| 5,642,128 | 6/1997 | Inoue | 345/96 |

FOREIGN PATENT DOCUMENTS 3-27195 12/1991 Japan .

*Primary Examiner*—Steven J. Saras
*Assistant Examiner*—Vincent E. Kovalick
*Attorney, Agent, or Firm*—Oblon, Spivak, McCelland, Maier & Neustadt, P.C.

[57] ABSTRACT

A liquid crystal display apparatus comprises a plurality of signal lines and scanning lines which are arranged so as to extend in directions orthogonal to each other and cross each other at cross portions, a plurality of pixel electrodes respectively provided at the cross portions so as to form a matrix arrangement, and a plurality of thin film transistors respectively provided between the pixel electrodes and the signal lines and respectively having gates connected with the scanning lines, for functioning as switches for writing image signals which are supplied from the signal lines into the pixel electrodes, picture change detecting means for detecting a change between still and moving pictures in a direction of time-axis included in a display image, and gate signal change means for changing the number of interlaced scanning lines in accordance with a change component detected in the picture change detecting means.

8 Claims, 24 Drawing Sheets

FIG. 1A
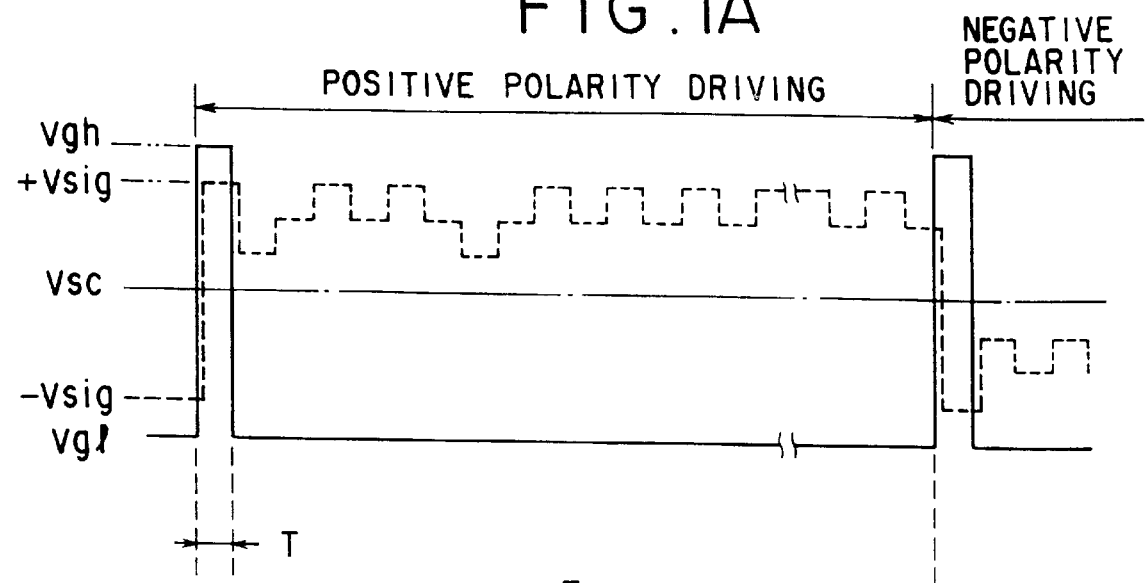
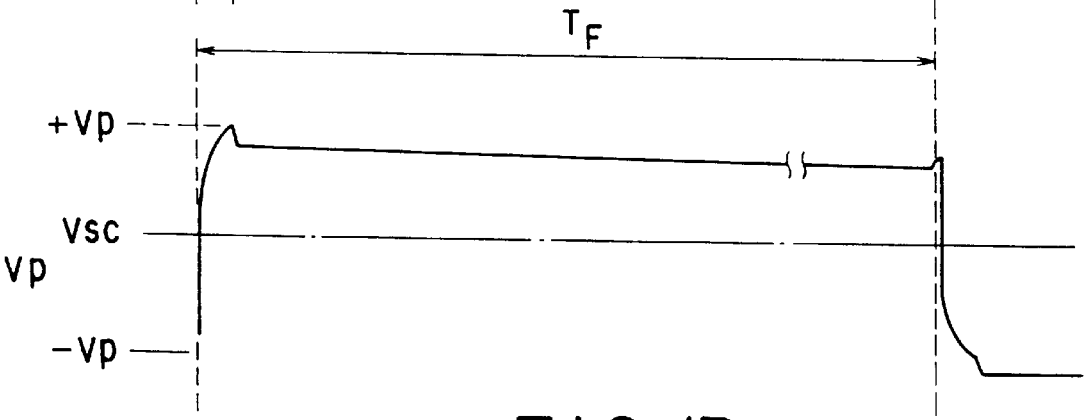
FIG. 1B
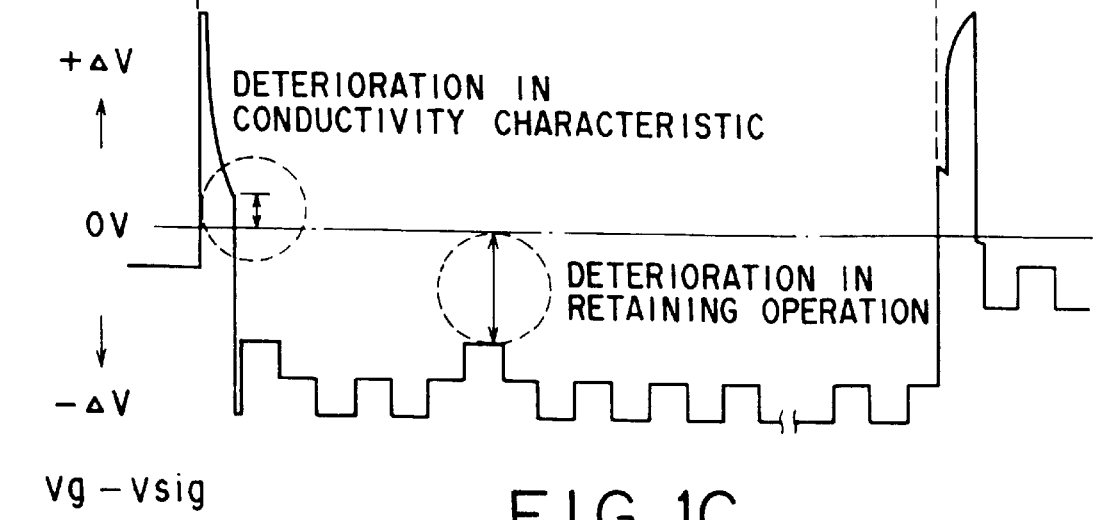
FIG. 1C

FIG. 6A
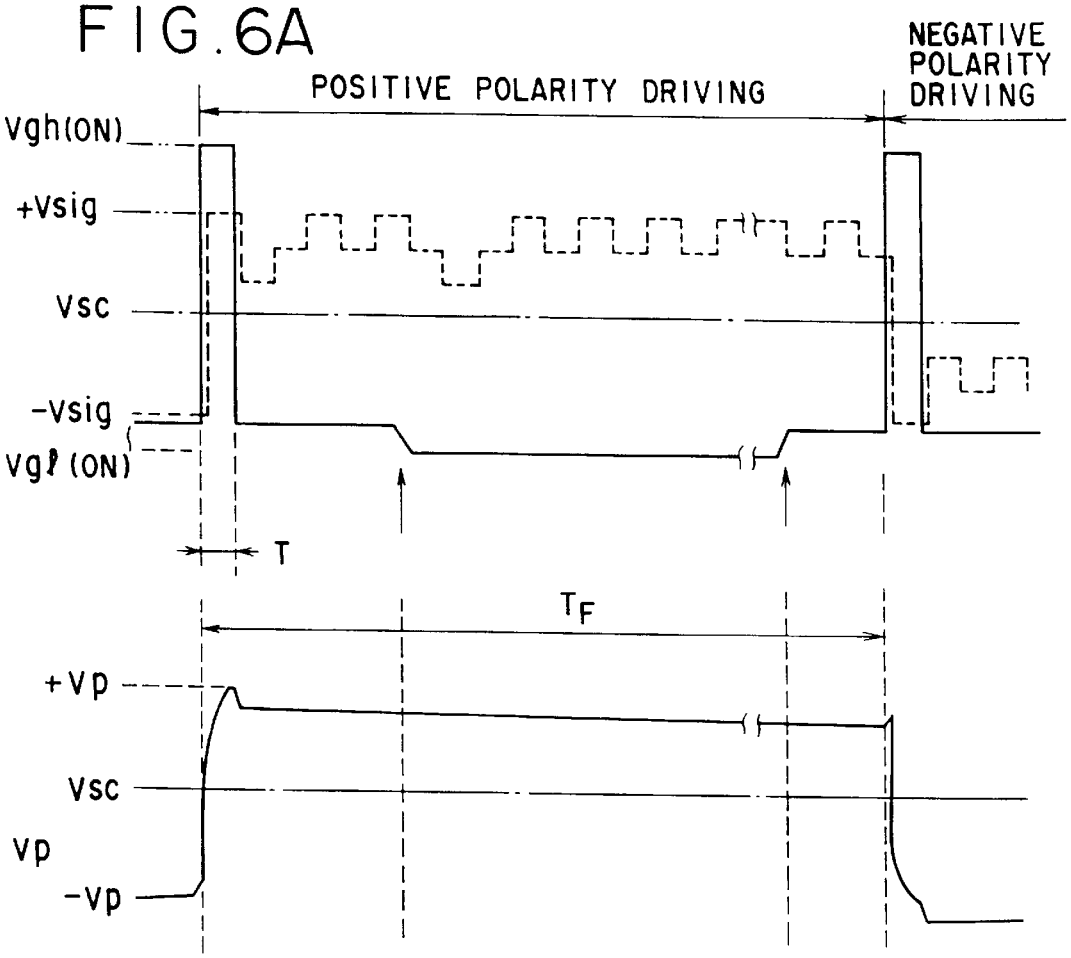
FIG. 6B
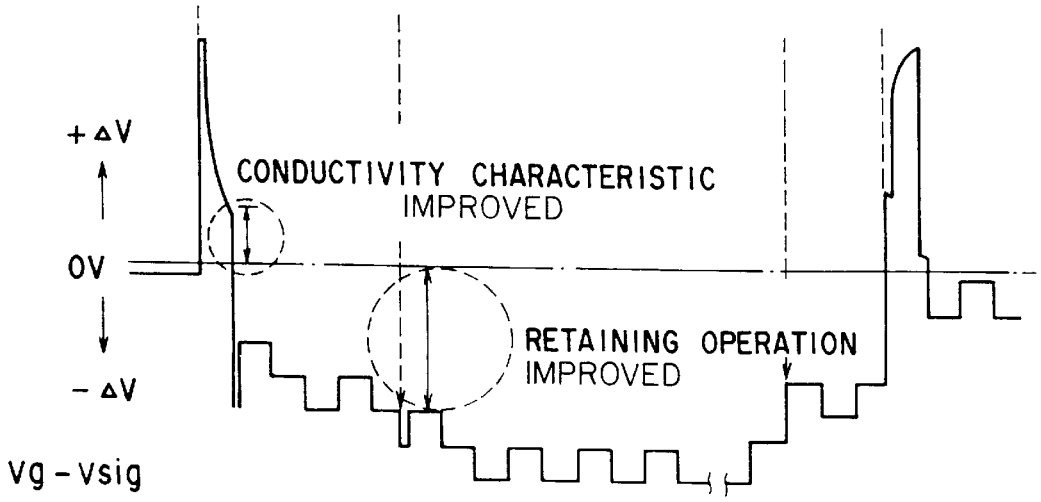
FIG. 6C

FLICKER COMPONENT AT MF DRIVING

FIGURES OF CONCEPT OF MF DRIVING METHOD (DISPLAYING m FRAMES)

FREQUENCY SPECTRA OF CHANGE IN LUMINANCE (MF DRIVING)

FIG. 21
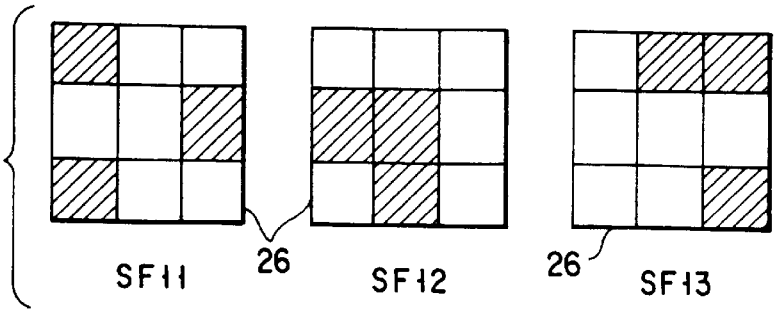
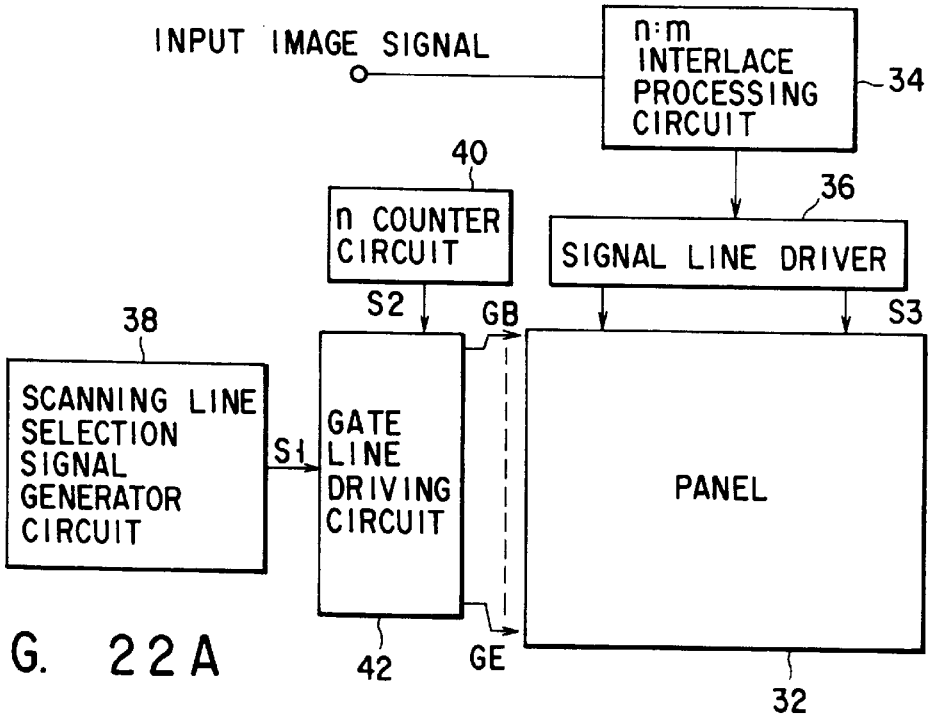
FIG. 22A
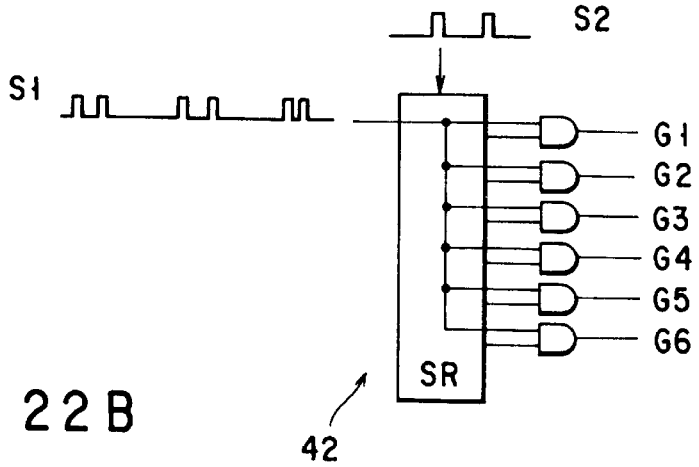
FIG. 22B

FIG. 23
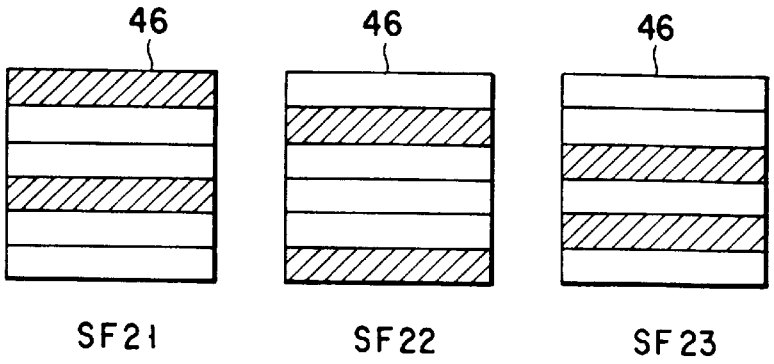
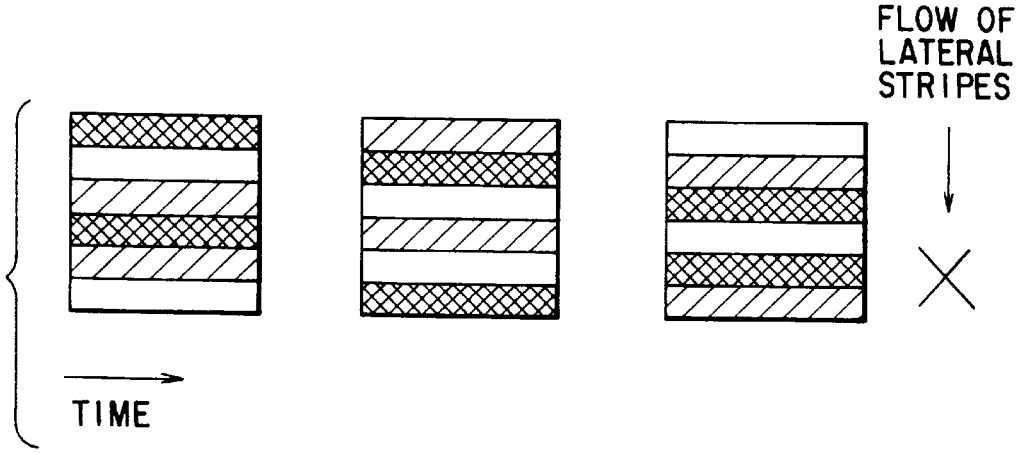
FIG. 25A
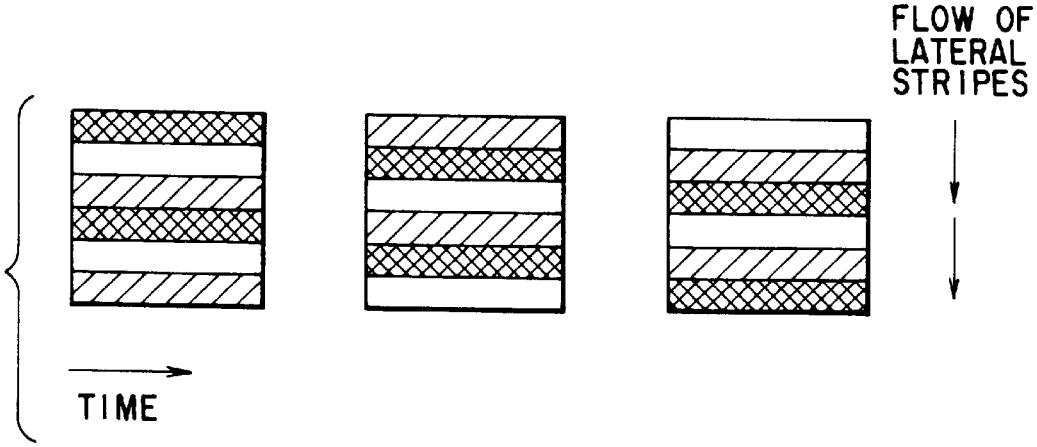
FIG. 25B
PRIOR ART

LIQUID CRYSTAL DISPLAY APPARATUS

BACKGROUND OF THE INVENTION

1. Field of the Invention

The present invention relates to a liquid crystal display apparatus, and particularly, to a liquid crystal display apparatus of an active matrix method in which a switching element is provided for each pixel, and also relates to a driving method of a liquid crystal display apparatus in which a switching element for selection is provided for each pixel or each scanning line.

2. Description of the Related Art

Generally, in a liquid crystal display (LCD) apparatus in which pixel electrodes are formed of switching elements provided at cross portions where signal lines and scanning lines have contact with each other and in which the pixel electrodes are arranged in a matrix, thin film transistors (TFTs) are broadly used as switching elements. A TFT used in this kind of TFT-LCD is an element consisting of three terminals, i.e., drain, gate, and source electrodes which are respectively connected with a signal line for supplying a display signal, a scanning line for supplying a scanning signal, and a pixel electrode forming a pixel. Therefore, in order to write a display signals into each pixel electrode, a display signal and a scanning signal are respectively applied to the drain and gate electrodes, so that writing is performed by rendering a path between the drain and source electrodes of the TFT electrically conductive. Further, to maintain display signals at respective pixel electrodes, a scanning signal is not applied to the gate electrode, and the electric conductance between the drain and source electrodes is reduced.

Conventionally, circuits for supplying display and scanning signals to be applied to TFTs (e.g., a display signal drive circuit and a scanning signal drive circuit) adopt a specific circuit configuration and use an integrated drive circuit (or IC). Thus, since a specific drive IC is used, withstanding characteristics of the IC are limited due to the process of manufacturing the IC and sufficient drive characteristics for all TFT-LCD cannot be obtained. For example, if TFT-LCDs are improved to attain high precision and the time required for scanning pixels is thereby shortened, sufficient conductive characteristics cannot be obtained, or if the scanning cycle is lengthened or the TFT-LCD is used in a severe environment, sufficient maintenance characteristics cannot be obtained. In these cases, display images are deteriorated or the TFT-LCD is deteriorated.

FIGS. 1A–1C are diagrams showing potential waveforms of respective electrodes in case of a frame inversion driving generally used to perform alternate current driving. The above problems will be explained with reference to FIGS. 1A–1C and 2. In a TFT-LCD, alternate current driving is performed so that liquid crystal may not be degraded by a direct current component. FIGS. 1A–1C show electric potential waveforms of respective electrodes in frame inversion drive which is generally used to perform alternate current drive. In FIG. 1A, reference +Vsig denotes a potential of positive polarity, reference −Vsig denotes a potential of negative polarity, reference Vsc denotes a center potential when a display signal is converted into an alternate current, and reference Vg denotes a scanning signal waveform. FIG. 1B shows a waveform of a pixel signal Vp which is retained by a pixel, and FIG. 1C shows a waveform of a potential difference Vg−Vsig between the pixel potential and the scanning signal waveform Vg.

FIG. 2 shows general characteristics of a TFT used as a switching element of a TFT-LCD. In FIG. 2, the lateral axis Vgs represents a voltage between the source and the gate of the TFT, i.e., a potential difference between the pixel potential Vp and the scanning signal Vg. In FIG. 2, the longitudinal axis Id denotes a drain current of the TFT, i.e., a current amount flowing between the pixel electrode and the display electrode. As is apparent from this figure, when a display signal is written, the amount of Id is greater as the voltage VGs is higher than 0[V], and the TFT is therefore rendered more conductive. When a display signal is maintained, the amount of ID is smaller when the voltage Vgs is lower than 0[V], and the maintenance characteristics of the TFT are improved.

However, in case of an actual TFT-LCD as shown in FIG. 1C, when a display signal of positive polarity is written, the potential difference Vgh−Vsig which corresponds to +Vgs of FIG. 2 decreases to be close to 0[V], and therefore, conductive characteristics of a TFT are degraded. When a display signal of negative polarity is maintained, the potential difference Vgl−Vsig which corresponds to −Vgs of FIG. 2 decreases to be close to 0[V], and therefore maintenance characteristics of the TFT is degraded.

Deterioration in conductive characteristics and maintenance characteristics as stated above is caused due to the narrow voltage range of the scanning signal Vg, i.e., the narrow dynamic range which greatly influences the conductive characteristics and maintenance characteristics, as is apparent from examples of FIGS. 1A–1C and 2. In addition, as explained above, the scanning signal drive circuit is integrated as an IC, and the dynamic range is decided by voltage-withstanding characteristics by means of the IC process. Therefore, as long as a scanning signal drive IC is still used without changes as in a conventional apparatus, the conductance characteristics (i.e., the writing characteristics and the maintenance characteristics) are consequently deteriorated so that image quality of a display image is degraded. Further, since liquid crystal cannot be completely driven by an alternate current, a voltage of a direct current is applied to the liquid crystal so that the TFT-LCD itself is disadvantageously degraded.

Meanwhile, as LCDs have been improved to have a higher resolution (i.e., to have more pixels) in recent years, the driving frequency has been increased to achieve high speed processing. In these circumstances, in order to make a driving IC be driven with a lower voltage so as to comply with operation of a high speed signal, proposals have been made to disclose common inversion driving (Jpn. Pat. Appln. KOKAI Publication No. 55-28649) for shifting a common electrode potential to an opposite polarity to the polarity of an image and source level shift driving (Japanese Patent Application No. 4-48313) for shifting a source voltage in accordance with polarity of an image. However, in common inversion driving, a common driver of a large capacitance must be driven at a horizontal driving cycle (of 15 to 30 micro seconds), and therefore, the power consumption is increased. In source level shift driving, since a large source capacitance must be driven, a strong driving circuit is therefore required and it is difficult to adopt this driving in an apparatus in which the power source must be driven with a high speed to perform dot inversion. Therefore, this source level shift driving is limited to signal line inversion driving. The signal line inversion driving is characterized in that a lateral cross talk does not easily occur due to an increase in resistance of the common electrode when the screen size is enlarged, and in that a longitudinal cross talk easily occur due to leakage from a TFT. Therefore, requirements for TFT characteristics are severe.

As a method for solving problems as stated above, a method has been proposed in which a switch is provided in a driving IC to switch signal lines for every field while maintaining the power source at a constant level (Jpn. Pat. Appln. KOKAI Publication No. 3-51887 and Japanese Patent Application No. 1-188299). However, in this method, the yield is lowered since the internal circuits of the liquid crystal panel must be newly designed and added, and since a high speed operation of a newly provided switch is requested a high performance device such as polysilicon etc., not amorphous silicon, is required and manufacturing processes become complicated.

Further, in recent years, another driving method (i.e., an MF driving method) has been proposed (Japanese Patent Application 2-69706). Although this MF driving method is effective for reducing power consumption and is also effective for surface flicker, the flicker component for every pixel is increased since maintenance time is greatly increased. Therefore, there is a problem in that this causes lateral stripes for each field to be visible to the eye, thereby causing deterioration of image quality of a standstill image.

Meanwhile, since a liquid crystal display apparatus is thin and lightweight and since the apparatus can be driven with a low voltage, the apparatus can be broadly used for devices beginning with a wrist-watch and a portable calculator and further including game devices of a small size. Further, the need for pen inputting electronic pocket notebooks have increased, so that demands on portable data access terminals are increased.

As a result of developments in multi-media, a plurality of images are displayed on one single screen. Since a large-size screen and high precision are required, the amount of data increases and the driving frequency increases. As a result of this, an increase in the power consumption has become a problem, and therefore, a driving method has been proposed by the present inventors to lower the power consumption (e.g., Japanese Patent Application No. 2-69706). This method in which the driving frequency is reduced by dividing a sheet of field image into an odd number of sub-fields is called an MF driving method. Although the MF driving method is very effective for reducing surface flicker, the maintenance period is greatly increased so that the flicker component for every pixel (normally for every line) is increased. Therefore, there is a problem in that this causes lateral stripes (or a line interruption) for every field to be visible to the eye, thereby causing deteriorating of image quality of a standstill image.

Further, it has been apparent from experiments that in a high precision image which is not interrelate with an image, respective flicker components are not compensated for, and of the flicker components, new carriers caused by differences between positive and negative polarities occur on a spatial frequency axis, thereby producing a reflected distortion. Since this reflected distortion is not standstill but is moving, it causes severe deterioration in image quality when the distortion enters into an area which can be viewed in accordance with time-spatial frequency characteristics of human visual perception.

As has been explained above, in the MF driving method, line disturbances and reflected distortion caused thereby deteriorate the image quality. Normally, to correct such deterioration, a correction is performed during a blanking period (or a fly-back period), but this correction is not sufficient.

Further, since the MF driving method deteriorates image quality of motion pictures since liquid crystal achieves poor response when motion pictures are displayed, and since an interval with which one pixel is driven is longer than one field, a interruption occurs, which an image is interlaced and disturbed to be comb-like, thereby deteriorating the image quality. In addition, with respect to a moving picture, there is another problem in that the driving frequency is decreased so that signals cannot be sufficiently rewritten and a residual image appears. Therefore, to deal with a moving picture, means of signal processing system is optionally required.

Thus, in an active matrix LCD using switching elements such as TFTs, even if the dynamic range of a scanning signal driving IC (which is decided by the manufacturing process of the scanning signal driving IC) is directly used without changes, deterioration of conductivity characteristics of a TFT and of maintenance characteristics is caused, so that not only is the image quality of a display image is degraded, but also the liquid crystal cannot be completely driven by an alternate current. Therefore, a direct current voltage component is applied to the liquid crystal, and the liquid crystal itself is degraded.

In addition, as the speed of the driving frequency is increased to achieve a high resolution, an increase in the power consumption is caused or the image quality is degraded by lateral cross talk and longitudinal cross talk. Further, in the MF driving method, by which the power consumption can be reduced, there is a problem in that line flickers of a standstill picture increase thereby causing line disturbances since a standstill image has a long maintenance period, while image quality of a moving picture is degraded since a preceding field remains with a comb like appearance.

SUMMARY OF THE INVENTION

The present invention has been made in view of the above situation, and has an object to provide a liquid crystal display apparatus which is capable of preventing deterioration in writing characteristics and maintenance characteristics due to the narrow dynamic range of a scanning signal driving IC decided by the manufacturing process of the scanning signal driving IC and also preventing the liquid crystal from being degraded, thereby ensuring high image quality and long life-time.

In addition, the present invention has another object to provide a liquid crystal display device whose power consumption is small and is capable of reproducing an image of high quality regardless of whether the image is a moving picture or a standstill picture.

The present invention has further another object to provide a driving method of a liquid crystal display apparatus for changing, among flicker component which cannot be sufficiently compensated for, reflected distortions caused by a difference between positive and negative polarities into an effect which is not visible with the eye, due to the time-spatial frequency characteristics of human visual perception.

The present invention has further another object to provide a driving method of a liquid crystal display apparatus for performing random driving according to certain signals, with respect to data such as a moving picture which has a frequency higher than the driving frequency, in order to restrict occurrences of residual image phenomena.

According to an aspect of the present invention, there is provided a liquid crystal display comprising: a plurality of sub-fields forcing one frame image separately, each sub-field being driven independently; means for driving each sub-field according to a predetermined drive scheme; and means for controlling an operation of the driving means.

According to another aspect of the present invention, there is provided a liquid crystal display apparatus comprising: a plurality of signal lines and scanning lines which are arranged so as to extend in directions orthogonal to each other and cross each other; pixel electrodes respectively provided at cross portions so as to form a matrix arrangement; and thin film transistors respectively provided between the pixel electrodes and the signal lines and having gates connected with the scanning lines, for functioning as switches for writing image signals into the pixel electrodes, characterized in that there is provided gate signal change means for making gate voltages or On-times of the gates of the thin film transistors change in accordance with signals which determine at least one of a writing-time, a maintenance time, and a scanning method.

Hence, the following are cited as preferred embodiments of the present invention. (1) Gate signal change means changing, as a control signal, an output of a standstill/moving detection circuit for determining whether an inputted image is a standstill picture or a moving picture. (2) A gage signal is controlled such that the number of lines to be driven differs between when an inputted image is a standstill picture and when an inputted image is a moving picture. (3) Gage signal change means including at least a circuit for changing a source voltage of a gate driving circuit. (4) A period or changing a gate signal is a period in which an image signal is not outputted to a signal line. (5) The OFF-level of a gate is shifted from the OFF-level corresponding to a minimum value of a flicker.

According to still another aspect of the present invention, there is provided a liquid crystal display apparatus comprising: a plurality of signal lines and scanning lines which are arranged so as to extend in directions orthogonal to each other and cross each other; pixel electrodes respectively provided at cross portions so as to form a matrix arrangement; and switching elements respectively connected between the pixel electrodes and the signal lines and controlled by the scanning lines, wherein the switching elements perform operation of writing display signals when scanning signals are applied to the scanning lines, and the switching elements perform operation of maintaining the display signals thereby displaying an image when scanning signals are not applied to the scanning lines, characterized in that there is provided scanning signal control means for controlling the scanning signals such that the switching elements have a higher conductivity characteristic during the operation of writing the display signals and such that the switching elements have a higher cut-off characteristic during the operation of maintaining the display signals.

Hence, the followings are cited as preferred embodiments of the present invention. (1) Switching elements are TFTs each having a source, a drain, and a gate respectively connected to a pixel electrode, a signal line, and a scanning line. (2) Scanning signal control means performs control such that a maximum value of an electric potential on the positive side of a withstanding voltage characteristic with respect to a grounding potential of a scanning electrode deriving circuit which supplies a scanning signal is outputted during operation of writing the display signal, and such that a maximum value of an electric potential on the negative side of the withstanding voltage characteristic with respect to the grounding potential is outputted during operation of maintaining the display signals. (3) Scanning signal control means controls a plurality of scanning electrode driving circuits, in such a manner in which the grounding potential and operating potential of each scanning electrode driving circuit are made variable during both the operation of writing the display signals and the operation of maintaining the display signals. (4) Scanning signal control means controls a plurality of scanning electrode driving circuits, in such a manner in which the operational potential of the scanning electrode driving circuit is made variable for each of the scanning electrode driving circuit.

According to the liquid crystal display apparatus of the present invention, scanning signals are controlled such that the voltage-withstanding characteristic of a scanning signal driving circuit or the like is shifted to the positive side during operation of writing display signals, thereby to raise the conductivity characteristic of switching elements respectively provided or pixels, while the voltage-withstanding characteristic of the scanning signal driving circuit or the like is shifted to the negative side during operation of maintaining display signals, thereby to raise the cut-off frequency characteristic of the switching elements for every pixel. As a result, the dynamic range of the scanning signal driving circuit or the like can be equivalently enlarged. Further, by preventing deterioration of the writing characteristic and the maintenance characteristic of switching element TFTs due to the narrow dynamic range inherent to a scanning signal driving IC, deterioration in image quality of a display image and deterioration of a liquid crystal itself can be prevented, so that a liquid crystal display apparatus having a high quality image and a long life time can be realized.

In addition, according to the liquid crystal display apparatus of the present invention, the leakage current characteristic and the ON-current characteristic of a TFT which cause a cross talk and a flicker can be controlled optimally in accordance with a driving time and a maintenance time, so that it is possible to reduce longitudinal cross talk or the like and to obtain high quality images while preserving an advantage of low power consumption.

Next, in the driving method according to the present invention, a display apparatus for displaying an image by means of A pixels or scanning lines which are respectively provided with selection switch elements is arranged such that a sheet of frame image is divided into n sub-fields which are displayed sequentially along the time axis and each of the sub-fields is basically formed of A/n×m pixels or scanning lines among the A pixels or scanning lines (where A is a positive integer, n is a positive integer which is equal to 3 or more and is equal to A or less, and m is a positive integer equal to n or less). To improve image quality, it is desirable if flickers can be compensated for between a pixel or scanning line on which writing is to be performed and pixels or scanning lines adjacent to the pixel or scanning line. When an image is displayed by scanning lines, image signals of a sheet of a frame image can be subjected to interlace processing with a ratio of n:m, and the switching elements can be selectively driven in accordance with image signals thus precessed.

According to still further aspect of the present invention, there is provided a driving method used in a display apparatus for displaying an image by means of A pixels or scanning lines which are respectively provided with selection switch elements, characterized in that a sheet of frame image is divided into n sub-fields which are displayed sequentially along a time axis, each of the sub-fields is basically formed of A/n×m pixels or scanning lines among the A pixels or scanning lines (where A is a positive integer, n is a positive integer which is equal to 3 or more and is equal to A or less, and m is a positive integer equal to n or less), and an interval between the pixels and scanning lines is changed for every sub-field or in one sub-field.

According to still further aspect of the present invention, there is provided a driving method used in a display apparatus for displaying an image by means of A pixels or scanning lines which are respectively provided with selection switch elements, characterized in that a sheet of frame image is divided into n sub-fields which are displayed sequentially along a time axis, each of the sub-fields is basically formed of A/n×m pixels or scanning lines among the A pixels or scanning lines (where A is a positive integer, n is a positive integer which is equal to 3 or more and is equal to A or less, and m is a positive integer equal to n or less), and the value of m/n is changed depending on the video signal.

According to still further aspect of the present invention, there is provided a driving method used in a display apparatus for displaying an image by means of A pixels or scanning lines which are respectively provided with selection switch elements, characterized in that a sheet of frame image is divided into n sub-fields which are displayed sequentially along a time axis, each of the sub-fields is basically formed of A/n×m pixels or scanning lines among the A pixels or scanning lines (where A is a positive integer, n is a positive integer which is equal to 3 or more and is equal to A or less, and m is a positive integer equal to n or less), and the sub-fields are grouped along the time-axis, so that a value of m/n differs between groups of the sub-fields. To compensate for changes in luminance on the screen caused by switching the value m/n, there can be provided means for detecting the screen luminance of a preceding sub-field prior to the switching of the value m/n, thereby to provide feed-back on the screen luminance of a next sub-field.

According still further aspect of the present invention, there is provided a driving method used in a display apparatus for displaying an image by means of A pixels or scanning lines which are respectively provided with selection switch elements, characterized in that a sheet of frame image is divided into n sub-fields which are displayed sequentially along a time axis, each of the sub-fields is basically formed of A/n×m pixels or scanning lines among the A pixels or scanning lines (where A is a positive integer, n is a positive integer which is equal to 3 or more and is equal to A or less, and m is a positive integer equal to n or less), and writing can be selectively performed with respect to displacement pixels or scanning lines among those pixels or scanning lines which do not belong to pixels or scanning lines of displayed sub-fields. It is possible to include a function of performing writing again to compensate for unevenness in luminance when writing is not performed with respect to a pixel or scanning line for several frames.

In the above aspects of the present invention, it is desirable to make intervals between pixels or scanning lines change for every sub-field.

According to the driving method of the liquid crystal display apparatus of the present invention, switch elements are not cyclically turned on and off in view of both the spatial cycle and the time-based cycle. Consequently, intervals between pixels or scanning lines are irregularly changed. As a result, changes in luminance of pixels, for example, which are caused by the maintenance characteristic of a liquid crystal, do not have a spatial cycle or a time-based cycle, and therefore, either the changes in luminance do not fall within a range which can be observed with the eye, or the changes can only be observed with difficulty. For example, when image signals are subjected to interlace precessing with a ratio of n:m to display an image by means of scanning lines, a selected scanning line interval irregularly changes within one frame. Since scanning lines which are turned on during a field period therefore do not have a spatial cycle, either changes in luminance of pixels caused by the maintenance characteristic of liquid crystal do not fall within a range which can be observed with the eye, or the changes can only be observed with difficulty. Further, in the case of a highly precise image which does not have an interrelation between images, when new carriers which are caused by a difference between flicker components of positive and negative polarities occur on a spatial frequency axis, thereby generating a reflected distortion, such a reflected distortion does not occur with a spatial cycle and therefore, does not fall within a range which can be observed with the visual time-spatial characteristics of the eye, or the changes can only be observed with difficulty. As a result, it is possible to greatly reduce deterioration of image quality.

Further, according to the driving method of the liquid crystal display apparatus of the present invention, for example, the value of m/n can be suitably changed with respect to a moving picture of a standstill picture.

Furthermore, according to the driving method of the liquid crystal display apparatus of the present invention, in cases where image signals which tend to easily generate flickers when driven at a predetermined constant value of m/n are inputted, the value of m/n is switched for each sub-field group and therefore, occurrences of patterns of flicker differ between groups, so that flickers are observed with difficulty. In the second and third aspects, if the screen luminance of a preceding sub-field prior to switching is detected and feedback is applied to the screen luminance of a next sub-field, changes in luminance of the screen can be compensated for by changing the value of m/n.

Still further, according to the driving method of the liquid crystal display apparatus of the present invention, for example, it is possible to eliminate residual images caused due to differences in luminance. With respect to images such as a moving picture and the likes whose data have a frequency higher than the driving frequency of a moving picture, image signals of one frame are sub-sampled and displayed, and therefore, image signals of one frame are divided into a plurality of sub-fields. As a result, pixels onto which signals have been once written maintain an image as once written during a non-selection period until signals are written again into the pixels, so that even if signals extremely different from the signals as once written are inputted, the such signals are not written but appear as residual an image. Therefore, driving is selectively performed with respect to those signals whose luminance level differs between a preceding frame and a next frame, so that residual images are prevented from being generated.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1A–1C are diagrams showing potential waveforms of respective electrodes in case of a frame inversion driving generally used to perform alternate current driving;

FIGS. 6A–6C are timing charts showing potentials of respective electrodes of a TFT-LCD panel where the output dynamic range of the scanning electrode driving circuit is increased in the first embodiment;

FIG. 21 shows sub-fields of the driving method according to the seventh embodiment of the present invention;

FIGS. 22A and 22B are diagrams showing the structure of a main part of the liquid crystal display apparatus according to the eight embodiment of the present invention;

FIG. 23 shows sub-fields of the driving method according to the eight embodiment of the preset invention;

FIGS. 25A and 25B compare the driving method according to the eight embodiment of the preset invention with a conventional MF driving method, with respect to phenomena of flowing lateral strips;

DETAILED DESCRIPTION OF THE PREFERRED EMBODIMENTS

Embodiments of the present invention will be explained with reference to the drawings. At first, an explanation will be made of an embodiment according to claim 1 of the present invention.

(First Embodiment)

Figure 2:
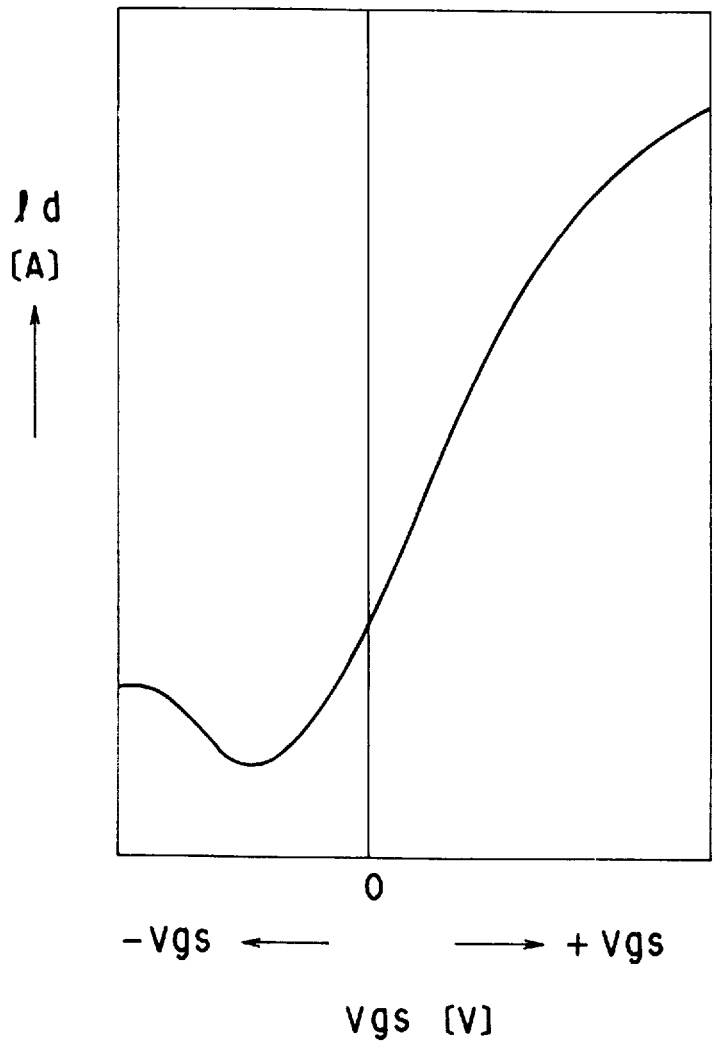
FIG. 2 is a graph showing general characteristics of a TFT used as a switching element.
Figure 3:
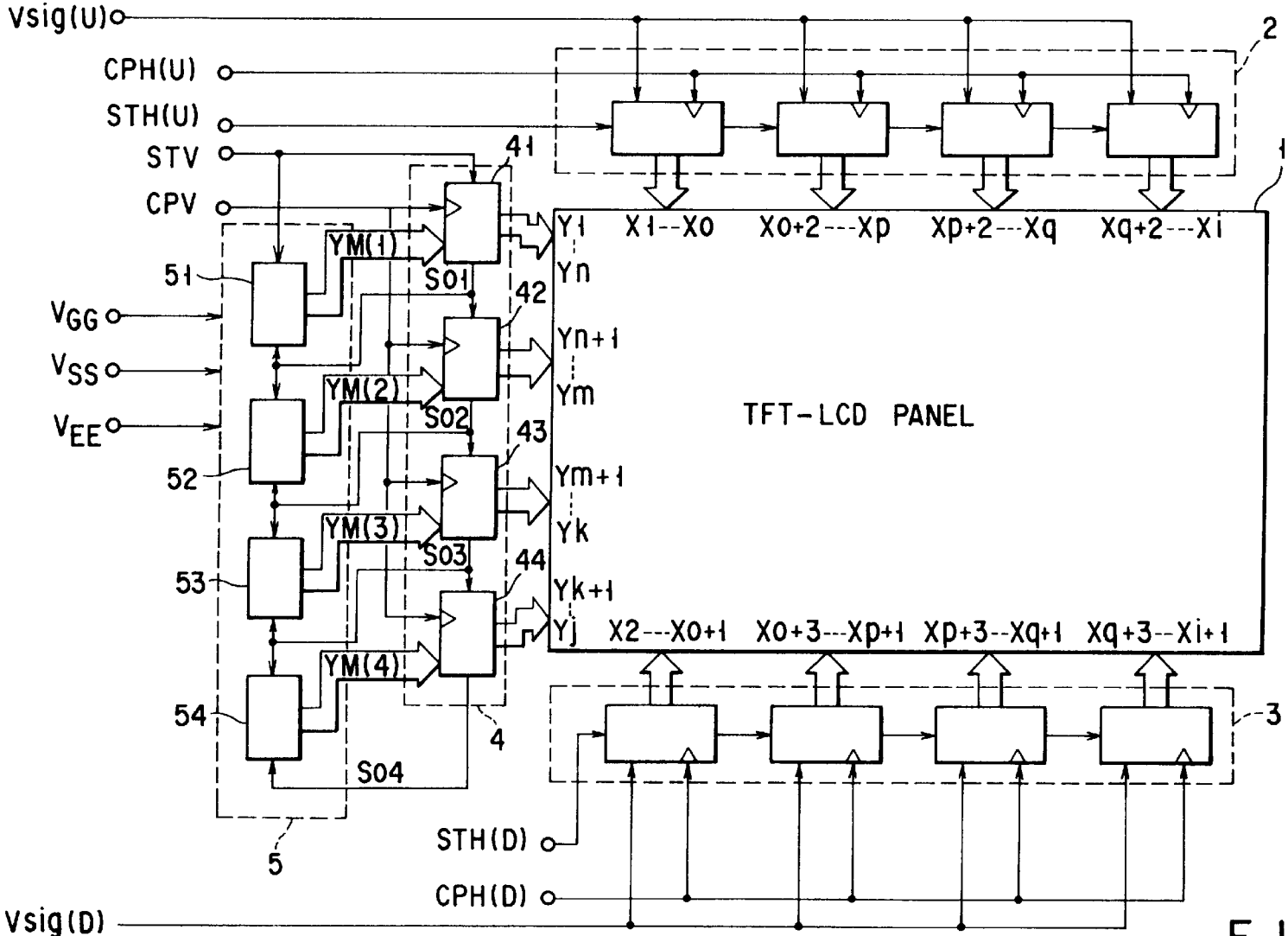
FIG. 3 is a block diagram showing a basic structure of a liquid crystal display apparatus according to a first embodiment of the present invention.

FIG. 3 is a block diagram showing a basic structure of a liquid crystal display apparatus according to a first embodiment of the present invention. This apparatus comprises a TFT-LCD panel 1, an upper display signal electrode driving circuit 2 for driving a display signal electrode of the TFT-LCD panel 1, a lower display signal electrode driving circuit 3 for driving the display signal electrode from the lower side of the panel, a scanning electrode driving circuit 4 for driving the scanning electrode of the TFT-LCD panel 1, and a scanning electrode control circuit 5 for controlling the dynamic range of the scanning electrode driving circuit 4. In the example of FIG. 3, a display signal Vsig (U) is supplied to the upper display signal electrode driving circuit 2, and an upper horizontal pulse on node CPH (U) for sampling the upper display signal Vsig (U), and an upper sampling pulse on node STH (U) for controlling a timing at which the display signal is sampled, are used to control the upper display signal electrode driving circuit 2 so as to supply the display signal Vsig (U) to the TFT-LCD panel 1. In the same manner, a lower display signal Vsig (D) is supplied to the lower display signal electrode driving circuit 3, and a display signal Vsig (D) of the lower display signal electrode driving circuit 3 is supplied to the TFT-LCD panel 1 by means of a lower control pulse consisting of a CPH (D) pulse and a STH (D) pulse. Display signals Vsig (U) and (D) respectively supplied from the upper and lower signal electrode driving circuits 2 and 3 are written into the TFT-LCD panel 1 by means of a scanning signal supplied from the scanning electrode driving circuit 4. As shown in FIG. 3, the scanning electrode driving circuit 4 consists of a plurality of scanning electrode driving ICs, and dynamic ranges of the scanning electrode driving ICs are respectively controlled by scanning electrode control circuit 5 corresponding to the ICs.

Figure 4:
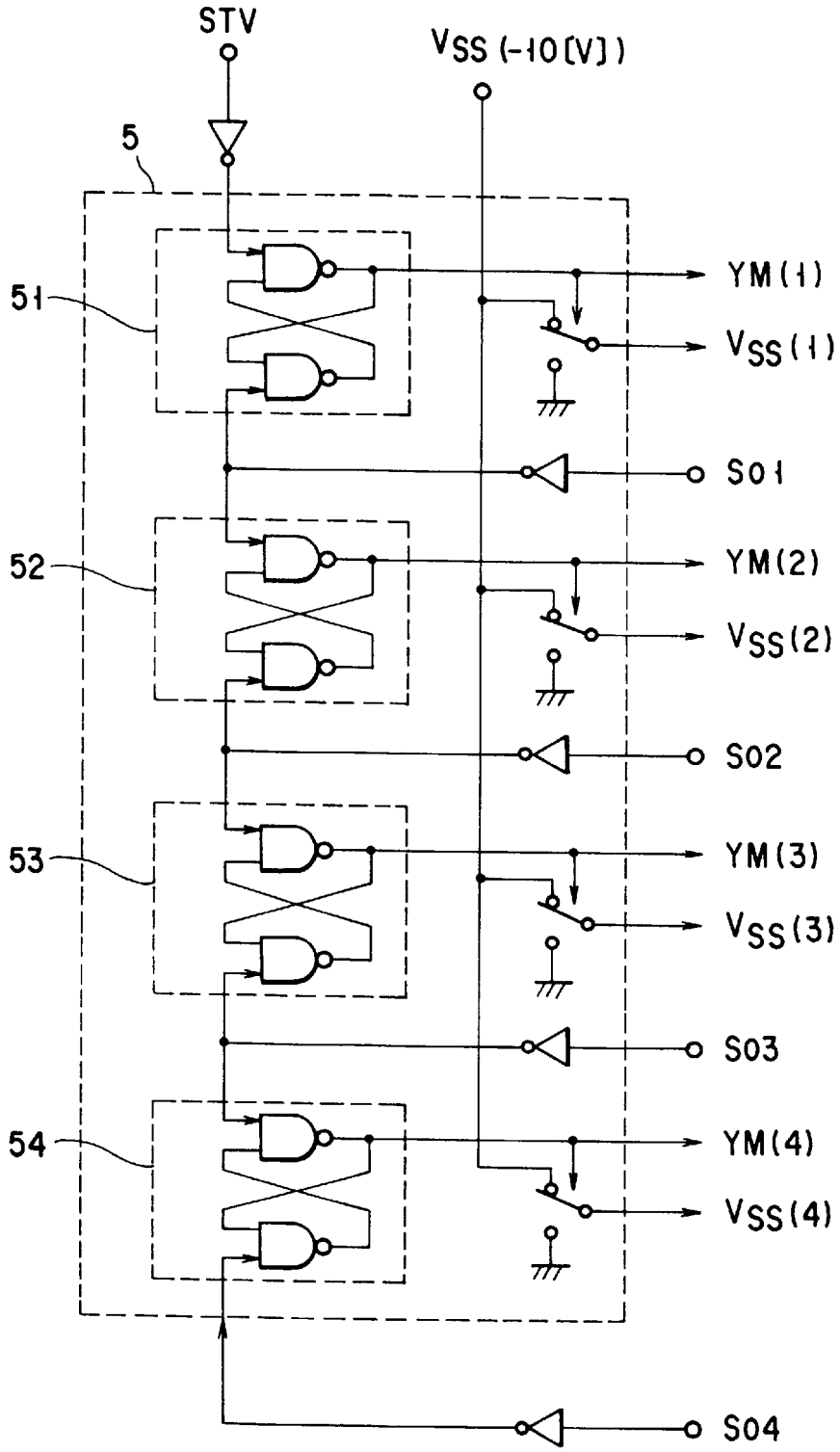
FIG. 4 is a diagram showing an example of a scanning electrode control circuit used in a first embodiment.

FIG. 4 shows an example of the scanning electrode control circuit 5 used in the first embodiment. This scanning electrode control circuit 5 consists of scanning electrode control circuits 51 to 54 corresponding to the scanning electrode driving ICs 41 to 44. The scanning electrode control circuits 51 to 54 detect whether or not the scanning electrode driving ICs 41 to 44 are outputting scanning signals, by means of scanning electrode control pulses STV and SO1 to SO4 which are inputted into and/or outputted from the scanning electrode driving ICs 41 to 44, and output mode signals YM1 to YM4, thereby controlling operation modes of corresponding scanning electrode driving ICs 41 to 44.

In the following, operation of the scanning electrode control circuit 5 will be specifically explained with reference to FIGS. 3 and 4. At first, the scanning electrode driving IC 41 which drives the n-th scanning electrode Yn from the first scanning electrode Y1 of the TFT-LCD panel 1 is controlled by the scanning electrode control circuit 51. A pulse on node STV which represents the start of scanning is inputted into the scanning electrode driving IC 41 and is simultaneously supplied to the scanning electrode control circuit 51, thereby to notify the scanning electrode control circuit 51 that the scanning electrode driving IC 41 is brought into a writing mode. By this operation, the scanning electrode control circuit 51 makes a mode signal, which is to be supplied to the scanning electrode driving IC 41, go to an H-level, and simultaneously, a potential Vss is supplied to the scanning electrode driving IC 41 by selecting a grounding potential GND level. In this manner, the scanning electrode driving IC 41 is rendered capable of supplying a scanning signal to a TFT-LCD, using the maximum potential of the plus side with respect to the grounding potential GND of the same IC as the scanning electrode driving level (or the writing level) with respect to the grounding potential GND level. For example, where TMC 57466 available from Texas Instruments Co., Ltd. is used as a scanning electrode driving IC, the maximum potential +30[V] of the plus side can be outputted with respect to the grounding potential GND level (see TFT Gate Driver Users' Manual TMC 57466, Japan Texas Instruments Co., Ltd.) In addition, when the scanning electrode driving IC 41 completes scanning up to the scanning electrode Yn and a pulse on node SO1 representing start of scanning is outputted to the scanning electrode driving IC 42 in the next stage, the SO1 pulse is inputted into the scanning electrode driving IC 42 in the next stage and is simultaneous inputted into the scanning electrode control circuit 52 in the next stage. Also simultaneously, the SO1 pulse is inputted into the scanning electrode control circuit 51, thereby switching the scanning mode of the scanning electrode control circuit 51 to the maintenance mode. When the scanning electrode control circuit 51 is once switched to the maintenance mode, a mode signal supplied to the scanning electrode driving IC 41 goes to a L-level, and simultaneously, a maintenance potential (−10[V]) is selected and supplied as the Vss potential to the scanning electrode driving IC 41. Therefore, when the scanning electrode driving IC 41 itself completes a writing operation, the IC 41 switches the maintenance potential to be supplied to the scanning electrode of the TFT-LCD, from the grounding potential GND level to a negative maintenance potential (−10[V]) and outputs the negative maintenance potential. Specifically, when the scanning electrode driving IC performs the writing operation, the maximum positive potential +30[V] can be outputted as a writing potential, and when the IC performs the maintenance operation, a negative maintenance potential −10[V] can be outputted. As a result, a dynamic range of an output voltage of 40[V] exceeding 30[V] (which is the maximum value of the voltage withstanding characteristics of the scanning electrode driving IC) can be realized.

Figure 5A:
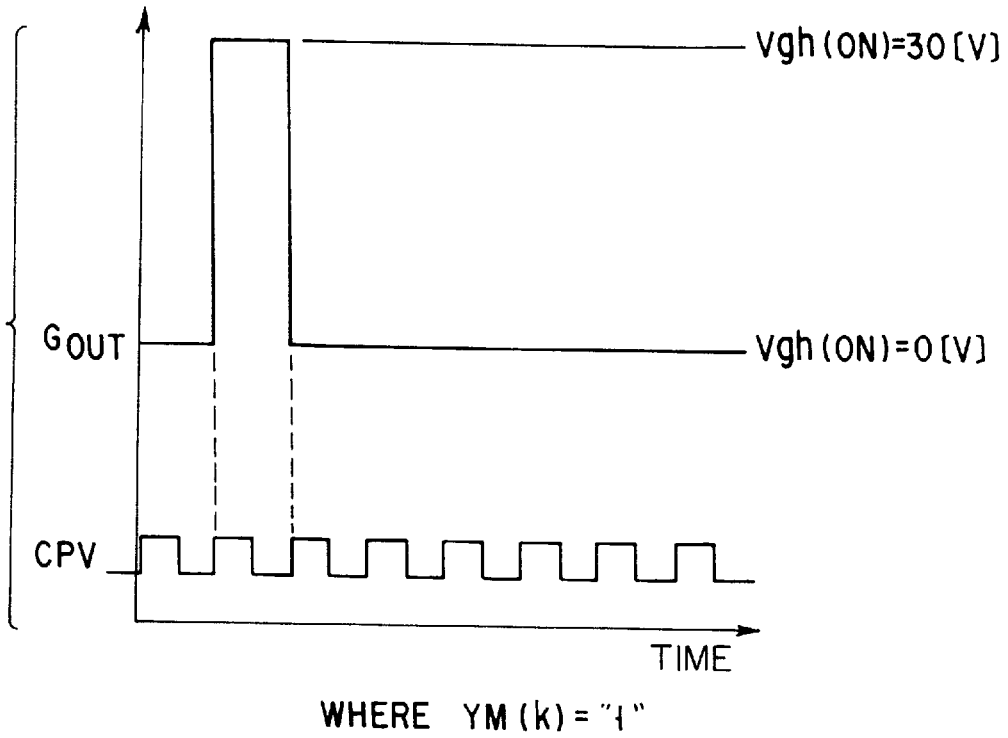
FIGS. 5A and 5B are timing chats showing examples of scanning signals where a scanning electrode drive circuit and a scanning electrode control circuit are used in the first embodiment.
Figure 5B:
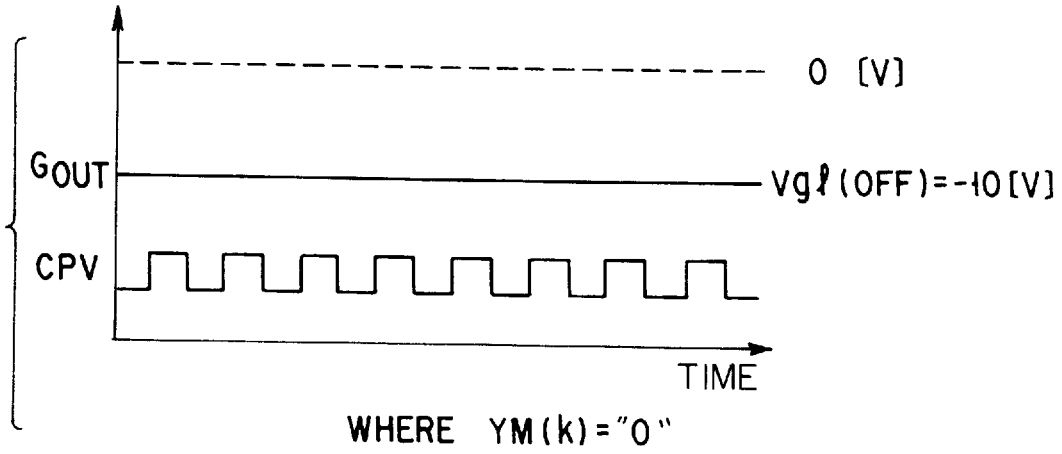

In the succeeding stages, the scanning electrode driving IC repeats the same mode control as explained above, so that the dynamic range of the voltage-withstanding characteristics of the scanning electrode driving IC is increased, thereby enabling writing and maintenance operations. FIGS. 5A and 5B show an example of a scanning signal where the scanning electrode driving circuit 4 of FIG. 3 and the scanning electrode control circuit 5 of FIG. 4 are used.

FIGS. 6A–6C show potentials of respective electrodes of the TFT-LCD panel 1 where the output dynamic range of the scanning electrode driving circuit 4 is increased. In FIG. 6A, reference +Vsig denotes a potential of positive polarity of an AC-converted display signal, reference −Vsig denotes a potential of minus polarity thereof, reference Vsc denotes a center potential when a display signal is AC-converted, and reference Vg denotes a scanning signal waveform. Further, FIG. 6B shows a pixel potential Vp which is a display signal maintained by a pixel, and in FIG. 6C a waveform of a potential difference Vg−Vsig between the pixel potential and the scanning signal waveform Vg.

In the first embodiment, unlike FIG. 1, a potential difference Vg-Vsig between the gate and pixel electrodes is positively shifted during the writing operation, compared to during normal operation, as shown in FIG. 6C, so that conductivity characteristics of the TFT are improved. In addition, in maintenance operation, a potential difference Vgs between gate and pixel electrodes is negatively shifted during maintenance operation compared to during normal operation, so that maintenance characteristics of the TFT are improved. Therefore, writing and maintenance characteristics of the TFT-LCD panel 1 are improved, so that display of a high quality image can be realized and simultaneously, deterioration of liquid crystal can be prevented.

(Second Embodiment)

Figure 7:
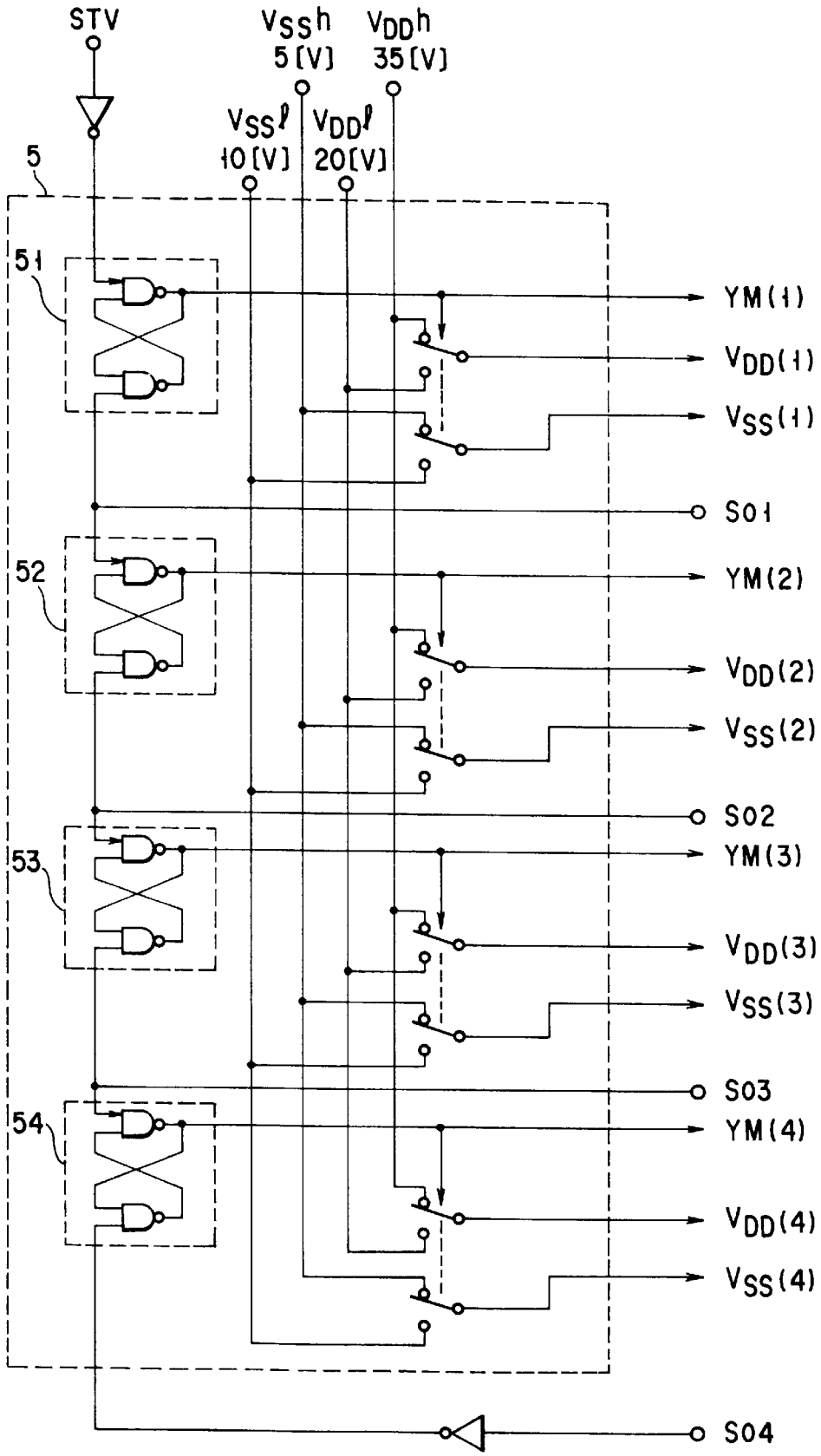
FIG. 7 is a diagram showing an example of structure of a scanning electrode control circuit 5 used in a second embodiment.

FIG. 7 is a diagram showing an example of structure of the scanning electrode control circuit 5 used in the second embodiment of the present invention. This is an embodiment where both of operational and grounding potentials are variable. In this embodiment, operation of the scanning electrode control circuit 5 is carried out in the same manner as above. A first, when a scanning electrode driving IC 41 starts scanning, a corresponding scanning electrode control circuit 51 is brought into a scanning mode, and a positive potential VDDh for a scanning mode is selected by the scanning electrode control circuit 51 and is supplied to the plus side of the scanning potential of the scanning electrode driving IC 41, while a negative potential Vssh for a scanning mode is supplied to the grounding potential of the scanning electrode driving IC 41. Next, at the same time when scanning of the scanning electrode driving IC 41 is completed, the scanning electrode control circuit 51 is switched to a maintenance mode, and a positive potential VDD1 for the maintenance mode is selected and is supplied to the grounding potential of the plus side of the scanning electrode driving IC 41, while a negative potential Vss1 for the maintenance mode is supplied to the grounding potential of the scanning electrode driving IC 41. Therefore, by using the embodiment shown in FIG. 7, the scanning electrode driving circuit 4 can output a potential of 35[V] during the scanning mode and a potential of −10[V] during the maintenance mode, so that the output dynamic range of the scanning electrode driving circuit can further be enlarged in comparison with the embodiment shown in FIG. 4. In addition, in a level shift circuit is constituted by using the grounding potential Vss(n) of the scanning electrode driving circuit 4 selected in FIG. 7, the potential of a scanning pulse applied to the scanning electrode driving circuit 4 can be shifted between the scanning and maintenance modes, and therefore, a broader output dynamic range can be obtained.

Figure 8:
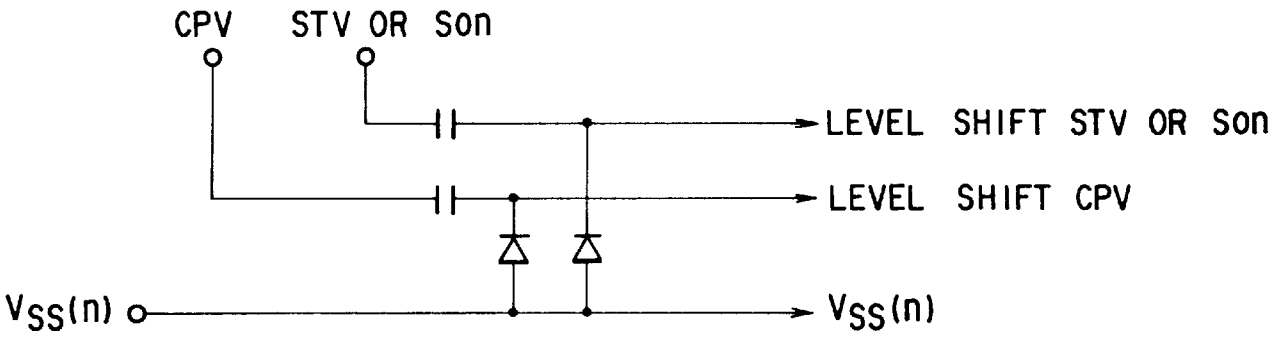
FIG. 8 is a diagram showing an example of structure of a level shift circuit in the second embodiment.

FIG. 8 shows an example of the structure of a level shift circuit shown in the second embodiment. In the structure of FIG. 8, since the L level (logic 0) of a scanning pulse applied to the scanning electrode driving circuit 4 can be clamped at Vss(n), the potential of the scanning pulse applied to the scanning electrode driving circuit 4 can be restricted within a range of voltage-withstanding characteristics of the scanning electrode driving circuit 4, regardless of the manner in which the source potential applied to the scanning electrode driving circuit 4 changes. Therefore, by combining a level shift circuit as shown in FIG. 8 with a scanning electrode control circuit as shown in FIG. 7, even a scanning electrode driving circuit which is operated by a single source can achieve operation using both the positive and negative power sources, if the potential Vss(n) is shifted to a positive potential in the scanning mode while the potential Vss(n) is shifted to a negative potential in the maintenance mode, so that levels of scanning pulses are shifted to the same potential.

(Third Embodiment)

Figure 9:
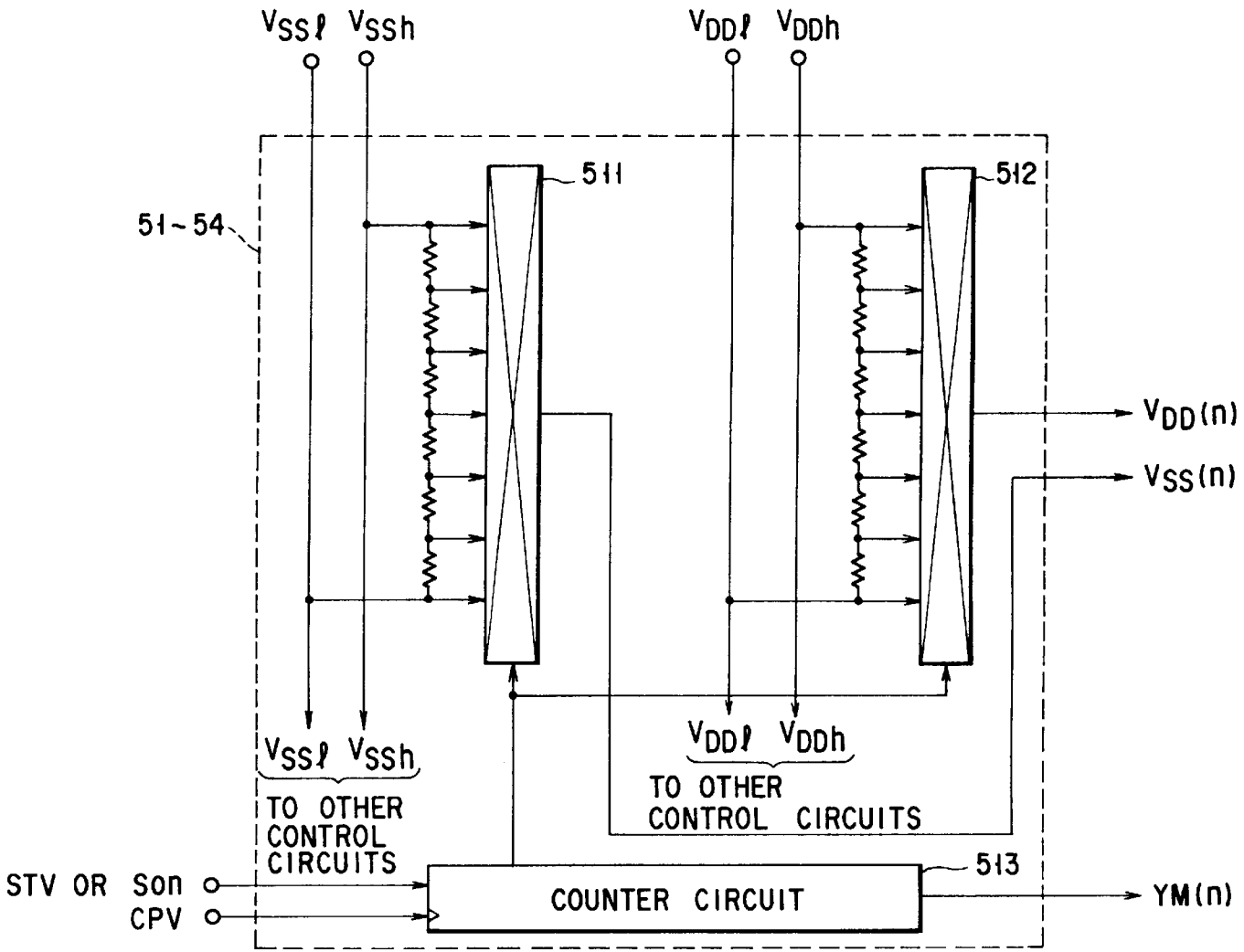
FIG. 9 is a diagram showing an example of structure of a scanning electrode control circuit used in a third embodiment.

FIG. 9 is a diagram showing an example of structure of the scanning electrode control circuit 5 used in the third embodiment of the present invention. In this structure, the scanning mode potential VDD(n) and the maintenance mode potential Vss(n) which are applied to the scanning electrode driving circuit 4 consist of a plurality of potentials, and these potentials are sequentially applied. FIG. 9 shows an example in which the potential difference from the high voltage side potential VDDh of the scanning mode to the high voltage side potential VDD1 of the maintenance mode is divided into four portions, and the potential difference from the low voltage side potential Vssh of the scanning mode to the high voltage side potential Vss1 of e maintenance mode is divided into four portions, so that the divided potentials are applied, one after another, to the scanning electrode driving circuit 4. In the embodiment of FIG. 9, the counter circuit 513 starts operating using a timing advanced by several lines compared to the timing with which the scanning electrode driving IC corresponding to the scanning electrode control circuit starts scanning. Selecting potentials from the maintenance potentials VDD1 and Vss1 to the scanning potentials VDDh and Vssh, one after another, for every predetermined scanning line, potentials VDD(n) and Vss(n) are applied to the scanning electrode driving circuit 4. Then, when the scanning electrode driving IC finishes scanning, the potentials VDD(n) and Vss(n) are applied to the scanning electrode driving circuit 4, selecting potentials from the scanning potentials VDDh and Vssh to the maintenance potentials Vss1 and VDD1. In this case, the potential VDD (n) is selected by a VDD selection circuit 512, and further, the potential Vss(n) is selected by a selection circuit 511. The selection circuit 511 and selection circuit 512 are controlled by the same counter circuit 513. Therefore, the potential difference between the potentials Vss(n) and Vss (n) which are simultaneously selected by the selection circuits 511 and 512 must be within a range of the voltage-withstanding characteristic of the scanning electrode driving circuit 4, while the potential difference can arbitrarily be set to a value within this range. As a result, by adopting the structure as shown in FIG. 7, an electric stress applied to the scanning electrode driving circuit 4 can be reduced, and simultaneously, another electric stress applied to the TFT-LCD panel can be reduced.

Thus, if the scanning electrode control circuit as shown in the above embodiments of the present invention is used, writing and maintenance characteristics of the TFT-LCD panel are improved, so that a high quality TFT-LCD can be realized and deterioration of the liquid crystal can be prevented. In additional, the above embodiments show that the writing and maintenance characteristics of the TFT-LCD panel can be improved by the scanning electrodes and the scanning electrode control circuits. The present intention, therefore, is not limited y the structure of the display signal electrode and the method of AC-converting a display signal applied to the TFT-LCD panel, or by the contents of display signals.

Next, theoretical study of the present invention is made before other embodiments of the liquid crystal display apparatus of the present invention will be described.

At first, consideration will be given to what factors decide the power consumption of a driving circuit (or a module circuit). The power consumption does not include a power consumed by a bias current flowing as a direct current. The driving circuit is basically divided into a signal line driving circuit, a buffer circuit, a control signal generating circuit, a common driving circuit, and a gate line driving circuit. Respective circuits will be specifically explained below.

(1) Signal line driving circuit

This circuit is a driving IC for driving a signal line which is classified into circuits of digital method and analog method. Since OFFICIAL ACTION images are formed by the digital method, consideration will first be taken into the power consumption of the digital method which achieves excellent consistency. The driving IC of the digital method basically comprises a shift register for deciding a sampling time of a signal, a latch circuit for latching a digital signal, a D/A converting circuit for converting a digital signal into an analog signal, and an output buffer for driving a signal line. Since the factors which divided the power consumption are a latch circuit and an output buffer, only these two factors will be discussed below.

The maximum power consumption $P_1$ is represented by the following equation where $C_1$ is an input equivalent capacitance relating to an image signal, $C_{ck}$ is an input equivalent capacitance relating to a sampling clock, and $f_s$ is a sampling frequency of an image.

$$P_1=(C_1+2C_{ck})\times(f_s/2)\times V_1^2 \quad (1)$$

The maximum power consumption $P_{ob}$ is represented by the following equation where $C_s$ is a signal line capacitance, $f_h$, is a horizontal driving frequency, and $N_h$ is the number of horizontal pixels.

$$P_{oh}=N_h\times C_s\times f_h\times V_s^2/2 \quad (2)$$

(2) A buffer circuit

A buffer circuit is a portion which receives an input digital signal, eliminates noise of the signal, shapes the waveform thereof, and supplies a stable signal to a signal line driving circuit. Although there is a case where a buffer circuit is omitted, this circuit will be discussed below since it is basically an indispensable component. The maximum power consumption $P_b$ of the buffer circuit is represented by the following equation where $C_{bc}$ is an input equivalent capacitance of a circuit relating to the clock $f_s$, and $C_{bp}$ is an input equivalent capacitance relating to an image signal.

$$P_b=(2C_{bc}+C_{bp})\times(f_s/2)\times V_b^2 \quad (3)$$

(3) A control signal generator circuit

This circuit basically uses an arrayed gate so that the internal frequency differs depending on signals. However, since the dependence of the power consumption on a sampling clock frequency $f_s$ of an image is considered to be a significant factor, the maximum power consumption $P_{ga}$ of the entire gate array is represented by the following equation where $C_{gac}$ is an equivalent internal capacitance of a circuit relating to the clock $f_s$ and $C_{ga}$ is an input equivalent capacitance of a circuit relating to an image signal.

$$P_{ga}=(2C_{gac}+C_{gap})\times(f_s/2)\times V_{ga}^2 \quad (4)$$

(4) A common driving circuit

This circuit is used to drive a common capacitance $C_c$, and the maximum power consumption $P_c$ of a common driving circuit is represented by the following equation where $f_c$ is a driving frequency of the common capacitance (which is half the horizontal driving frequency $f_h$ when the common is inverted.)

$$P_c = C_c \times f_c \times V_c^2 \tag{5}$$

(5) A gate line driving circuit

This circuit is used to drive capacitance $C_g$ of a gate line, and the maximum power consumption $P_g$ of a gate line driving circuit is represented by the following equation where $f_g$ is a driving frequency of a gate line (which is normally a horizontal driving frequency $f_h$).

$$P_g = C_g \times f_h \times V_g^2 \tag{6}$$

(6) Power consumption $P_{all}$ of the entire circuit

From the above the power consumption $P_{all}$ of the entire circuit is obtained as follows:

$$\begin{aligned} P_{all} &= P_1 + P_{ob} + P_b + P_{ga} + P_c + P_g \\ &= (C_1 + 2C_{ck}) \times (f_s/2) \times V_1^2 + \\ &\quad N_h \times C_s \times f_h \times V_s^2/2 + \\ &\quad (2C_{bc} + C_{bp}) \times (f_s/2) \times V_b^2 + \\ &\quad (2C_{gac} + C_{gap}) \times (f^s/2) \times V_{ga}^2 + \\ &\quad C_c \times f_c \times V_c^2 + C_g \times f_h \times V_g^2 \end{aligned}$$

Where the common is a constant voltage and a relation of $N_h \times C_s >> C_g$ exists, the power consumption will be as follows:

$$\begin{aligned} P_{all} &= (C_1 + 2C_{ck} + 2C_{bc} + C_{bp} + 2C_{gac} + C_{gap}) \times \\ &\quad (f_s/2) \times V^2 + N_h + C^s(f^h/2)V_2 \\ &= P_{all}(C, f, V) \end{aligned} \tag{7}$$

Thus, the power consumption is represented as a function of the capacitance C, driving frequency f (i.e., the clock frequency and the horizontal frequency of an image) and the voltage V.

Here, the capacitance C is decided depending on the structure of a device, the voltage V is decided depending on the process and the structure of the liquid crystal panel, such as the process and the V-T characteristic. On the other hand, the frequency f is decided depending on the system and image quality, such as the horizontal scanning frequency and the flicker characteristic of an image, so that the frequency f can be decreased by a driving method. Note that, when the normal driving frequency is decreased, the maintenance period is lengthened and there is a larger decrease in the pixel potential. Consequently, flicker components are increased and the frequency of the flicker components is decreased, even if the TFT has the same off leakage current. Therefore, flickers are more easily visible, which causes severe deterioration in image quality.

In view of the above, a driving method (called an MF driving method) has recently been proposed in which the driving frequency is decreased by dividing a sheet of field image into an odd number of sub-fields (Japanese Patent Application No. 2-69706).

Figure 16:
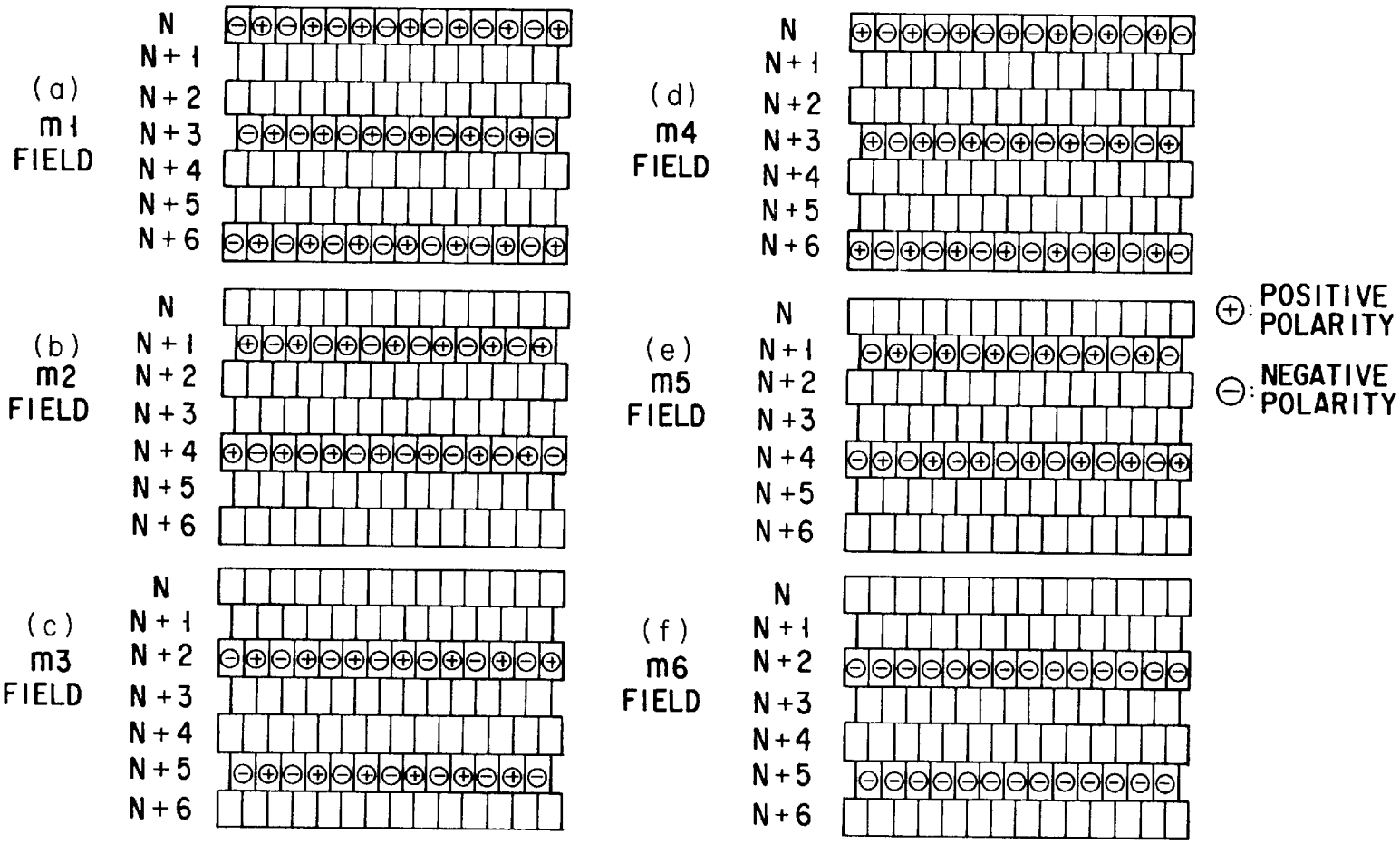
FIGS. 16 show the concept of an MF driving method.
Figure 19:
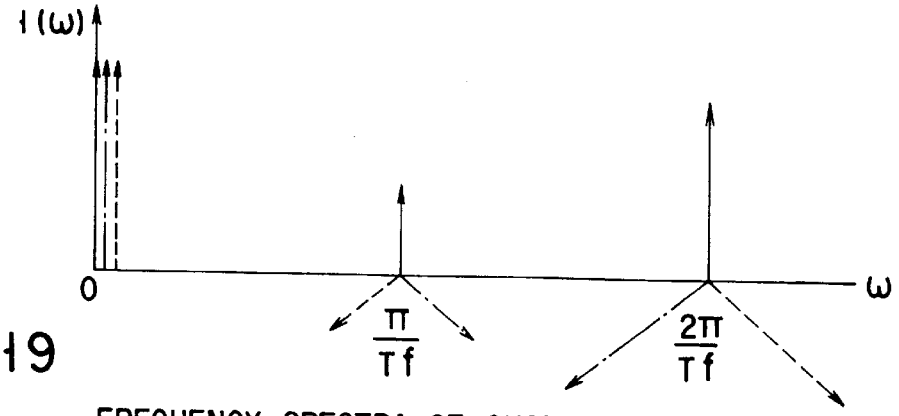
FIG. 19 is a graph showing frequency spectra of luminance changes.

FIG. 16 shows a concept of the MF driving method. First, the following explanation will be made to the driving method where an m-th frame is displayed. During the first $T_f/3$ period, gate lines or 1, 4, . . . , N, N+3, N+6, . . . lines are driven as shown in FIG. 16(*a*), and simultaneously, signal line inversion driving is carried out by respectively supplying image signals of positive and negative polarities to odd-numbered and even-numbered signal lines. During the next $T_f/3$ period, gate lines for 2, 5, . . . , N+1, N+4, N+7, . . . lines are driven, as shown in FIG. 16(*b*). During the further next $T_f/3$ period, gate lines for 3, 6, . . . , N+2, N+5, N+8, . . . lines are driven as shown in FIG. 16(*c*). In the next $T_f/3$ period coming thereafter, lines to be driven return to the first $T_f/3$ period, i.e., gate lines for 1, 4, . . . , N, N+3, N+6, . . . lines are driven as shown in FIG. 16(*d*), while the lines are driven with polarities opposite to those of FIG. 16(*a*) so that AC driving can be achieved. In the following period, lines are driven in the same manner as above except that the polarities of FIGS. 16(*b*) and 16(*c*) are reversed, and therefore, specific explanation thereof will be omitted herefrom.

Analysis will be made below as to how flicker components will be processed when the above driving method is carried out. At first, factors which cause flickers are considered as follows:

(1) A shortage in a ON-current (2) A penetration voltage of a TFT (3) An OFF-current of a TFT Factors (1) and (2) can be solved by an array structure and by a penetration correction driving method, while factor (3) is considered to influence the flicker characteristic more severely than usual, provided that the OFF characteristics including light leakage from a TFT are not complete, considering that the MF driving method principally serves to render a maintenance period of the TFT longer than a normal driving method. Therefore, factor (3) will be analyzed thoroughly, as follows.

Figure 17A:
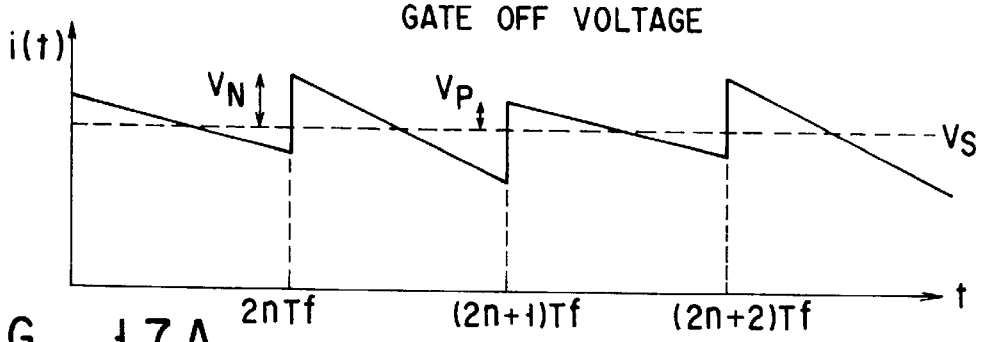
FIGS. 17A and 17B are graphs showing potential change waveforms and flicker components.

A potential change waveform of a pixel is approximated as shown in FIG. 17A. Specifically, the maintenance is superior when driving is performed with a positive polarity, so that a potential change of Vp occurs within a field. In contrast, the maintenance is inferior when the apparatus is driven with a negative polarity, so that a potential change equivalent to $Vn(>V_p)$ occurs within a field. In this state, the potential i(t) is represented as follow:

$$\begin{aligned} i(t) &= Vs + Vn - (2Vnt/\pi)(0 \leqq t \leqq \pi) \\ i(t) &= Vs + Vp - (2Vpt/\pi)(-\pi \leqq t < 0) \end{aligned} \tag{8}$$

Although an actual change in transmittance must be obtained by multiplying the response characteristic of the liquid crystal by the above change on the frequency axis, the response characteristic is a complicated characteristic depending on the potential level. Herein, only the potential changes of pixels are analyzed as luminance changes.

A potential change will be subjected to a Fourier expansion as described below:

$$\begin{aligned} i(t) &= Vs + (1/\pi) \sum_{K=1} [2/(k^2\pi)]\{1 - (-1)^k\} \\ &\quad x(Vn - Vp)\sin kt + (1/k)\{1 - (-1)^k\} \\ &\quad x(Vn - Vp)\cos kt \end{aligned} \tag{9}$$

Here, taking into consideration only a basic wave component (30 Hz) which is important as a flicker, the following is obtained when k=1.

$$F_{30} = (4/\pi^2)(Vn - Vp) \tag{10}$$

Figure 17B:
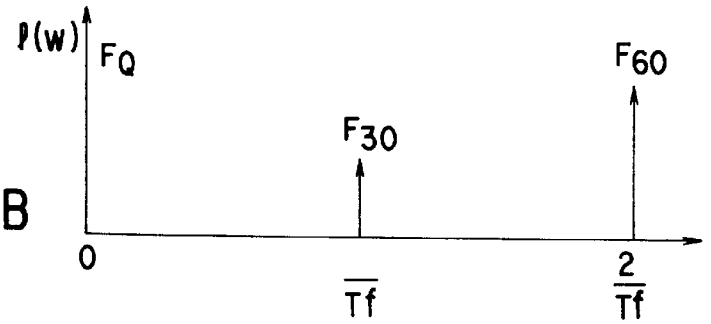

Specifically, each pixel has a spectrum $F_{30}$ as shown in FIG. 17B. Methods for eliminating such a flicker component will be described as follows:

(1) A method of causing the luminance change i(t) to have a high frequency.

(2) A method of using adjacent pixels for compensation.

Since an image signal is normally used at a high speed, method (1) is not used frequently. Line inversion (or common inversion) and signal line inversion are normally use to perform compensation using two pixels in method (2). This method will be explained in more detail.

At first, in any of the above methods, since signals of opposite polarities are inputted into adjacent pixels, an averaged luminance $i_a(t)$ between two adjacent pixels is represented by the following equation.

$$i_a(t)=i(t)+i(t-\pi/\omega_0) \tag{11}$$

This equation is subjected to Fourier conversion as follows:

$$I_a(\omega)=I(\omega)\{1-\exp(j\omega\pi/\omega_0)\} \tag{12}$$

Accordingly, an equation of $I_a(W_0=0$ is obtained, so that flicker components can be completely removed.

Although the above relates to a case where two pixels are compensated for, the MF driving method proposed by the present inventors is designed to compensate or N pixels where an averaged luminance $i_a(t)$ between adjacent N pixels and the Fourier conversion $I_a(W)$ is as follows:

$$i_a(t) = \sum_{n=0}^{N} i(t + n/N \times \pi/\omega_0) \tag{13}$$

$$i_a\Big( \omega = \sum_{n=0}^{N} I(\omega)\exp\{j(n/N)\omega\pi/\omega_0) \tag{14}$$

Figure 18A:
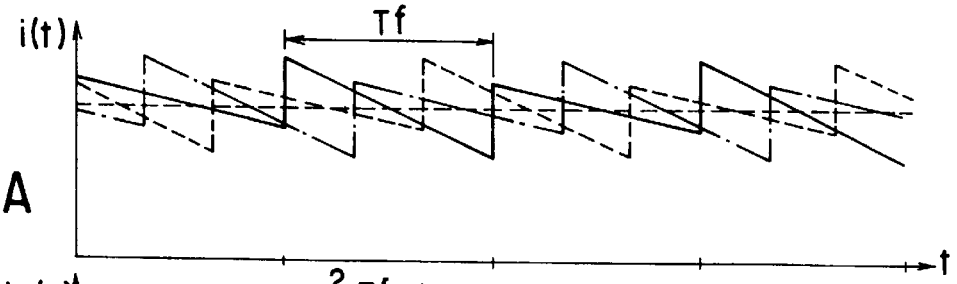
FIGS. 18A and 18B are graphs showing flicker components during MF driving.
Figure 18B:
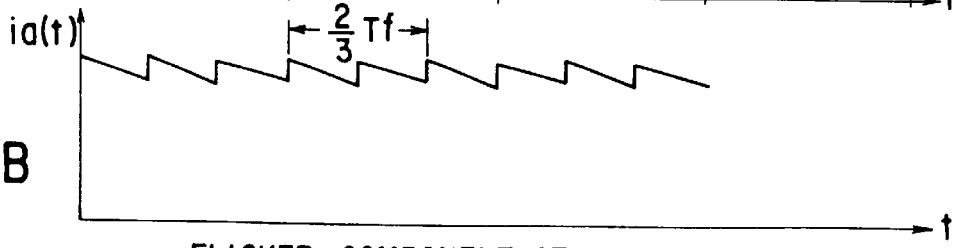

The following explanation will be made with reference to an example in which flicker components are compensated for with the use of three pixels. In FIG. 18A, transmittance changes i of three pixels obtained from the equation (8) are respectively indicated by a continuous line, a dashed line, and a broken line, while the entire transmittance change in this state is indicated as $i_a(t)$. In addition, frequency spectra are also shown in FIG. 17. As is apparent from FIG. 18A, if the transmittance changes i(t) to be compensated for each other are equal to each other, the flicker component which was originally $2T_f$ ($T_f$: a flicker cycle=1/60 second) can be changed to $2T_f/3$, i.e., 1/3 flicker cycle of 1/60 second by means of three-pixel compensation. Therefore, the flicker component cannot be defected with the eyes. This means that phases of spectra of respective pixels are shifted from each other by an angle of 120° and are added to each other as vectors, so that flicker components are eliminated as is apparent from the equation (13) from the view point of the frequency spectra. With use of this principle, compensation of pixels of 3, 5, 7, . . . , 2N+1, i.e., compensation of odd-numbered pixels can be performed in the same manner as stated above. Therefore, the greater the number of pixels which can be compensated for is, the smaller the driving frequency can be. The power consumption can thus be reduced.

In general, the power consumption $P_{MF}$ is obtained from the relation (7) which determines the power consumption.

$$\begin{aligned} P_{MF} &= (C_1 + 2C_{ck} + 2C_{bc} + C_{bp} + C_{gap}) \times \\ &\quad \{f_s/2(2N+1)\} \times V^2 + \\ &\quad N_h \times C_s \times \{f_h/2(2N+1)\} \times V^2 \\ &= P_{all}/(2N+1) \end{aligned} \tag{15}$$

As is apparent from this relation, the power consumption depending on the driving frequency of a module circuit can e reduced to 1/(2N+1), so that the power consumption can be greatly reduced.

On the basis of results of analysis of the MF driving method, experimental tests of decreasing effects of flickers were carried out with use of an actual panel. These tests were fundamental tests and were carried out under the condition that N=1, i.e., the number of sub-fields was 3.

1) Normal driving (60 Hz)
2) Where the driving frequency is solely decreased (20 Hz)
3) MF driving (N=1)

With respect to the above three modes, a gray level of a transmittance 50% was displayed and a time-based change in transmittance was detected by a photo-detector. The detected time domain change was converted into the frequency domain by means of an FFT analyzer, and analysis and estimation were made as to how much basic waves of 20, 40, and 60 Hz-components were included.

With respect to the normal driving, 20HZ-driving, and the MF driving (N=1), a result obtained by measuring a relative level with respect to an averaged luminance of flicker components is shown in the following table 1. The following can be seen from the table 1.

| Driving | Frequency Component of Flicker (dB) | | | | |
|---|---|---|---|---|---|
| Method | 20 Hz | 40 Hz | 60 Hz | | 80 Hz |
| MF Driving | −53 | | −41 | | |
| Signal Line Inversion | −51 | | −39 | | |
| 20 Hz Driving | −26 | −34 | −41 | −45 | ← For Flicker Of Each Pixel |

(1) Where the driving frequency is decreased to 20 Hz, flicker components of 20, 40, 60, 80, . . . Hz were generated as had been estimated.

(2) A frequency component of 20 Hz was eliminated by the MF driving as had been predicted, and a frequency component of 60 Hz (three times as high in frequency as the component of 20 Hz) was substituted.

(3) The normal driving and the MF driving showed the same level with respect to a frequency component of 60 Hz, and deterioration of image quality is substantially equal to the normal driving.

As has been explained above, the MF driving method is effective with respect to a surface flicker, while a maintenance time is greatly lengthened so that the flicker component for each pixel (normally for each line) is increased, as shown in the table 1. Therefore, lateral stripes are observed with eyes and a reflected distortion, caused by the difference between maintenance characteristics of positive and negative polarities, causes deterioration in image quality of a standstill picture. These are all called a line-disturbance. Further, the MF driving method attains a poor response when a moving picture is displayed, and an interval in which one pixel is driven is longer than one field, so that interlacing occurs, thereby causing a comb-line disturbance on an image and image quality of a moving picture is deteriorated.

In order to solve this problem, the present invention includes gate voltage variable means for changing the gate voltage of a thin film transistor which serves as a switch for wiring an image signal, in accordance with a writing time and a maintenance time. In the following, embodiments of the present invention will be explained.

(Fourth Embodiment)

Figure 10:
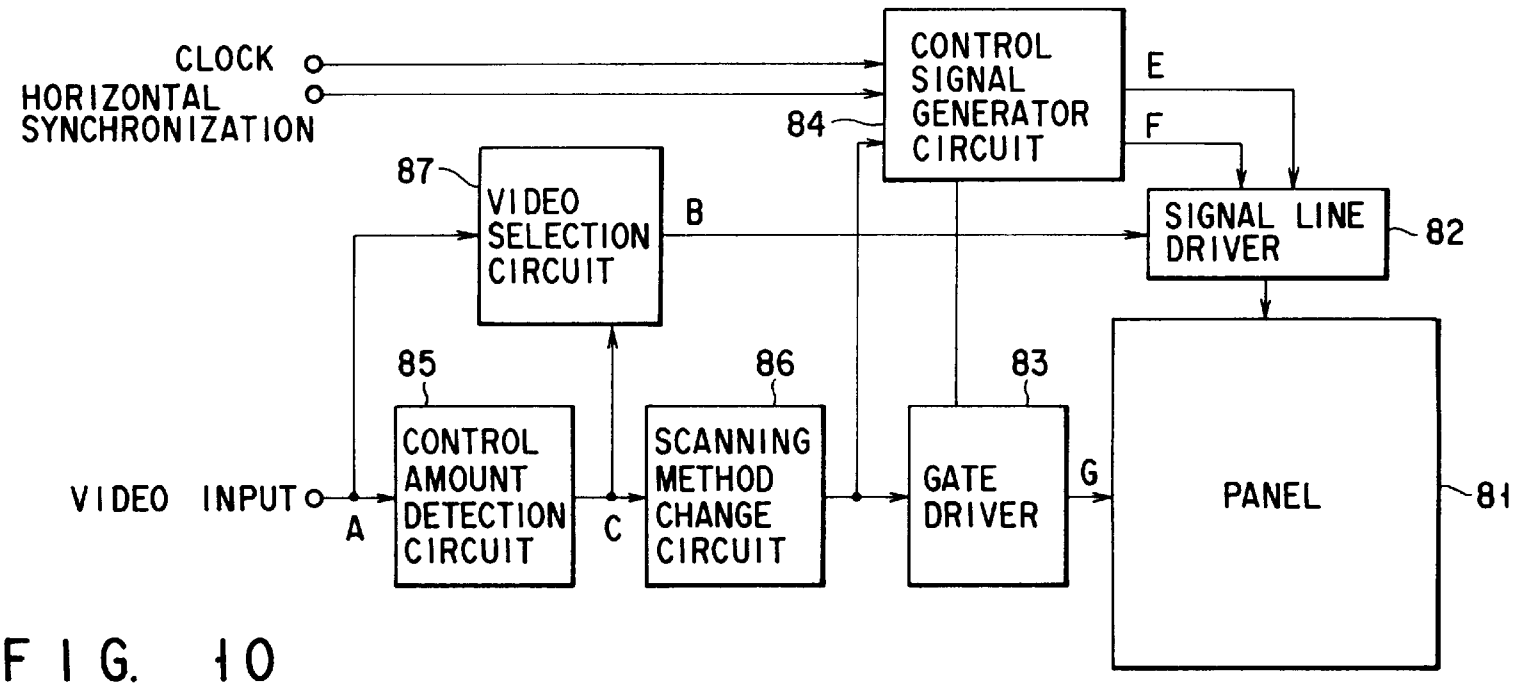
FIG. 10 is block diagram showing an example of circuit configuration in a fourth embodiment.
Figure 11:
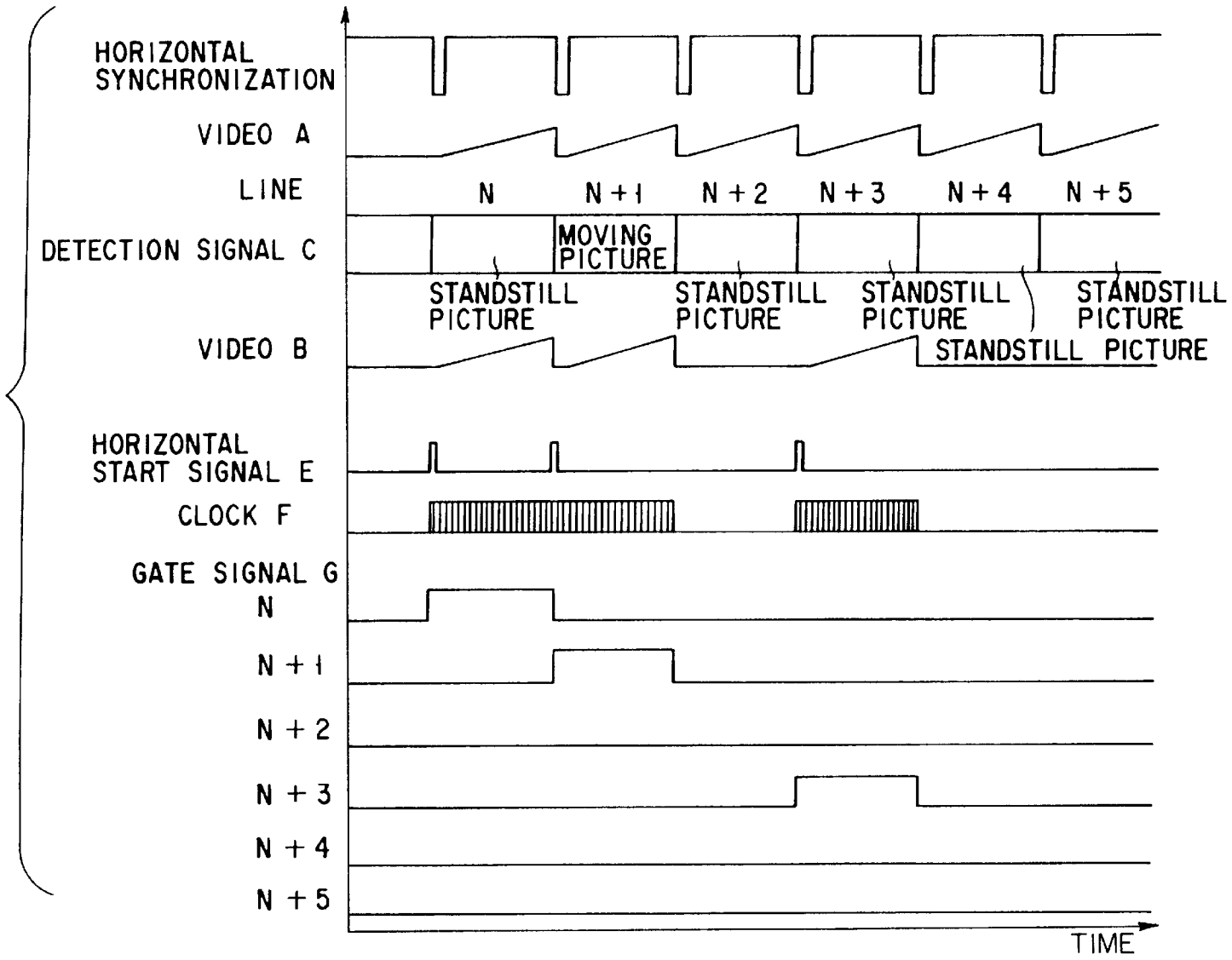
FIG. 11 is a timing chart showing driving voltages of gates in the fourth embodiment.

FIG. 10 shows a circuit configuration in a fourth embodiment of the present invention. FIG. 11 shows a signal waveform in this state. In FIG. 10, reference 81 denotes a liquid crystal panel, reference 82 denotes a signal line driver, reference 83 denotes a gate driver, reference 84 denotes a control signal generator, reference 85 denotes a control amount detection circuit, reference 86 denotes a scanning method variable circuit, and reference 87 denotes a video image selection circuit. In this embodiment a standstill/moving picture detection circuit (e.g., a control amount detection circuit 85 in FIG. 10) is used to detect whether signals for one scanning line of an image or signals or one pixel thereof are changing. Various methods for defecting whether an image is a standstill or moving picture are considered, and examples of the methods will be explained below.

(1) When a least one pixel of a scanning line changes by a given threshold Sth1 or more within a field period, the scanning line is detected as a change, i.e., a moving picture.

(2) Among pixels constituting one scanning line, when any pixel thereof changes by a threshold Sth2 or more within one field period, and this pixel changes by a given second threshold Sth3 or more, the scanning line is detected as a change, i.e., a moving picture.

(3) When an amount is obtained by weighting and adding amounts of changes of pixels with each other, where these pixels constitute one scanning line within one field, and this amount changes by a given threshold Sth4 or more, the scanning line is detected as a change, i.e., a moving picture.

(4) When a moving picture is displayed in an window, there is a case in which a file itself is provided with identification data, and only the portion of the picture can be changed without comprising a detection circuit by then transmitting the data or by maintaining the data in a memory until the file is changed.

(5) When the writing operation is performed using the write signal of the video memory to be used for displaying, the picture is determined to be a moving picture.

(6) When the signal for accessing the graphic controller is generated, the picture is determined to be a moving picture.

Other than the examples as explained above, a detection method taking into consideration combinations and the frequency of changes or weighting according to the visual characteristics of eyes, the present invention can be modified without deviation from the scope of the claims.

On the basis of detection results, video signals may be applied to gates or a gate driver for a TFT may be controlled. Specifically, scanning signals (which are normally clear signals or output enable signals for a gate driver) are switched from each other such that scanning lines (i.e., lines N N+3, . . . in this embodiment) which are scanned within a field are simply scanned. The other scanning lines (which are not necessarily scanned) within the field are scanned only if those scanning lines are part of the moving portion of the picture. This example shows a case where lines are scanned at a high level and are not scanned at a low level. Further, in the present embodiment, when scanning is not carried out with respect to video signals, gates are used so that video signals might not be inputted into the signal line driver. Otherwise, when scanning is not performed, scanning can be omitted by taking a measure for stopping clocks. Also, it is preferable that, in order to reduce a penetration current by the scanning signal, the slant of the leading edge and the trailing edge of the scanning signal is lowered instead of providing an off period in the scanning signal pulse wave.

Although the scanning method is controlled by detecting standstill and moving pictures in the fourth embodiment, the scanning method including a gate scanning period, a maintenance period, the number of interlaced scanning lines and the like may be changed in the other manners, e.g., by means of the temperature, the amount of incident light, signals which influence the ON/OFF characteristics of a TFT such as polarities of display image signals, and signals which influence the remaining charge in the batteries, desired operation times, and a remaining period for software. Specifically, when the scanning method is used in portable devices, the power consumption is considered more significant than the image quality, and therefore, the standstill/moving picture detection circuit may be prevented from operating by providing a low power consumption mode.

In the same way, to further lower the power consumption, it is possible to adopt a method in which scanning intervals in the standstill picture mode are more broadened with use of a signal detecting the remaining amount of batteries and a power consumption mode switching signal (including a case of using a method of reducing the amount of back light which has been practiced and which can elongate the maintenance period since leakage of light from a TFT is reduced by decreasing the amount of light), such that the interval of every three lines in the above embodiment is broadened to be an interval which complies with a fifth line, a seventh line, and a 2N+1 line (where N is an integer), without deviating from the scope of the present invention. Note hat although an analog signal is used as a video signal to allow easy understanding of the description, a digital signal can be used in the same manner as above.

(Fifth Embodiment)

Figure 12:
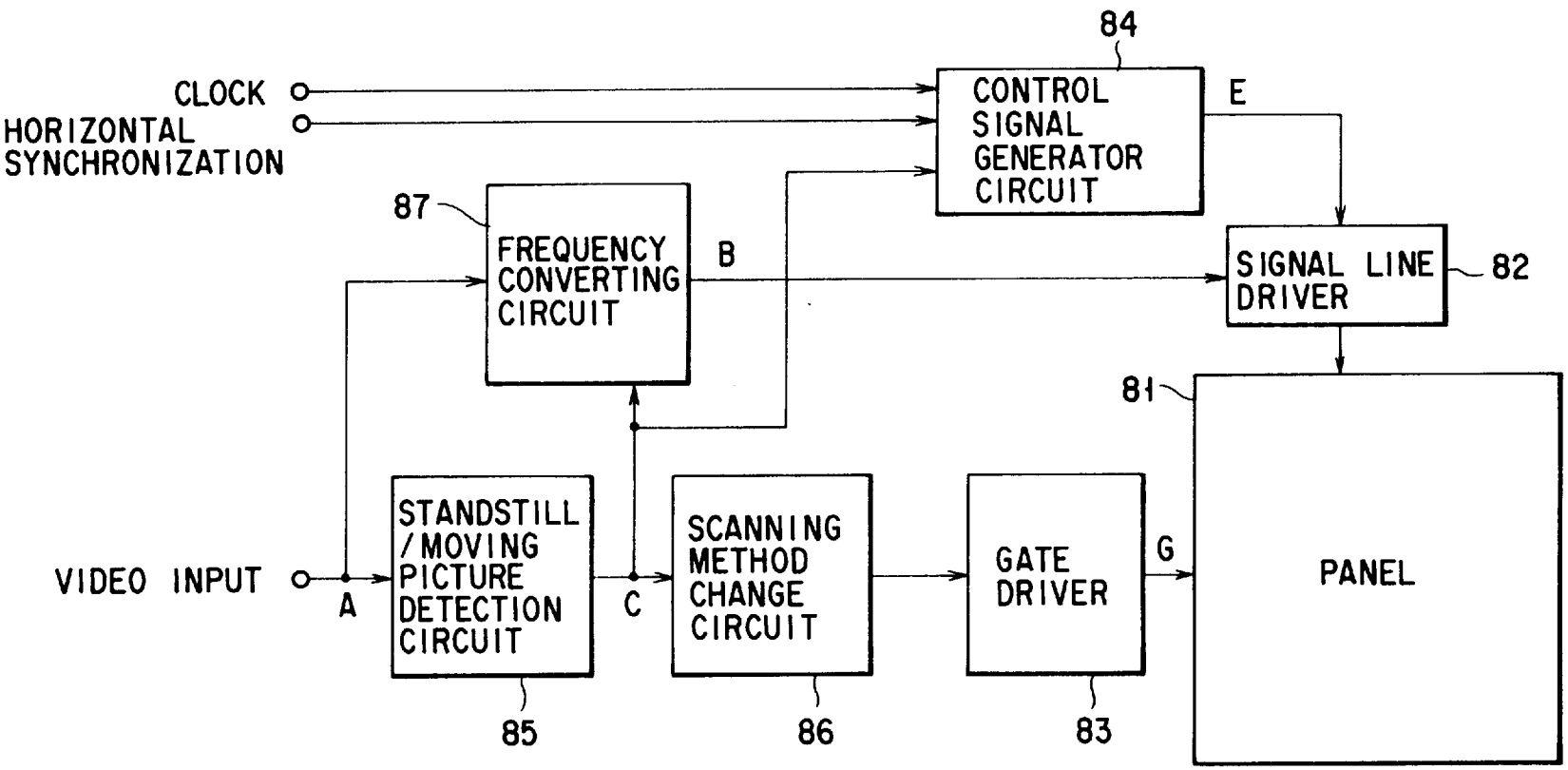
FIG. 12 is a block diagram showing a circuit configuration in a fifth embodiment.
Figure 13:
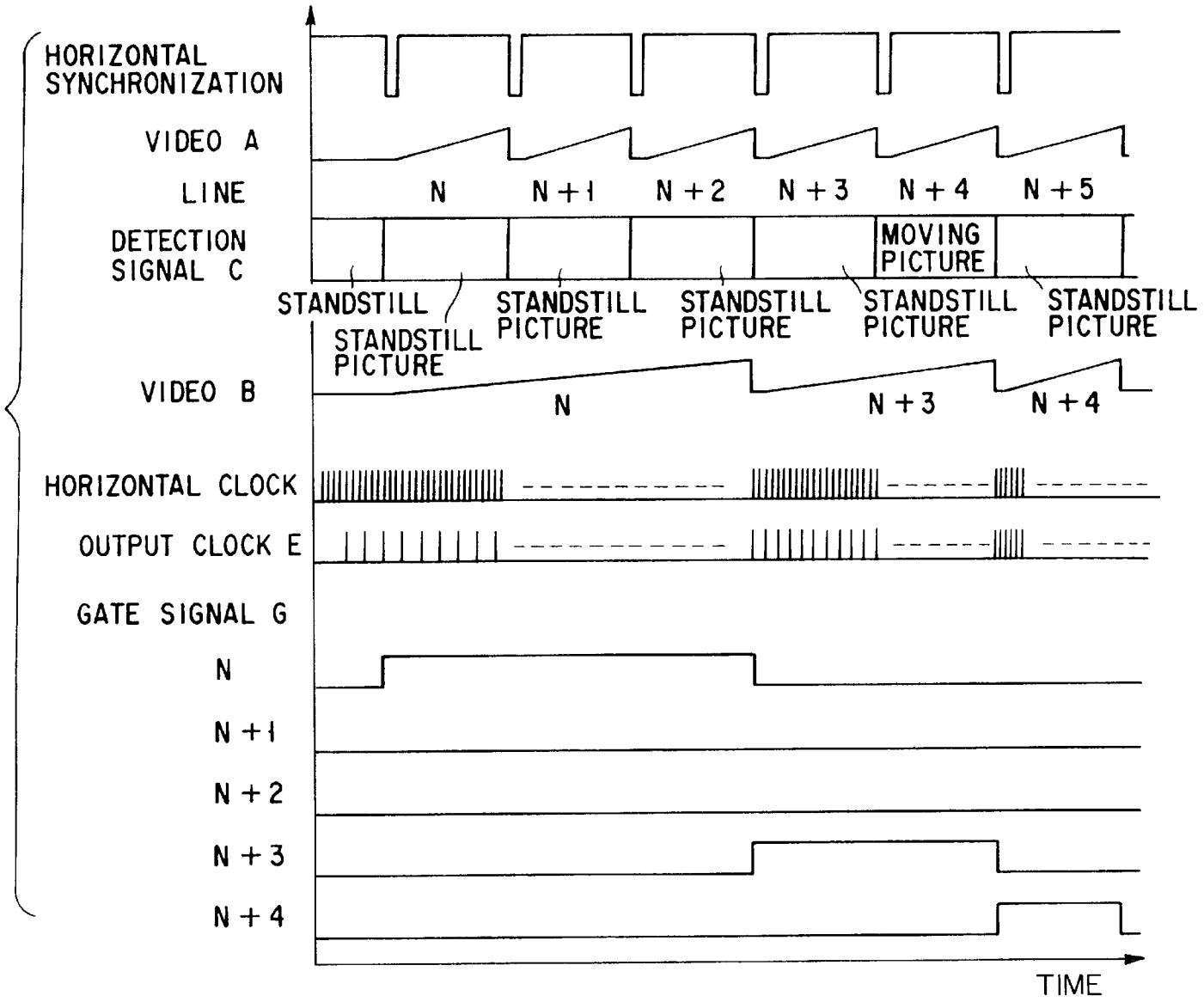
FIG. 13 is a timing chart showing driving voltages of gates in the fifth embodiment.

FIG. 12 shows a circuit configuration in the fifth embodiment of the present invention. FIG. 13 shows a signal waveform in this state. In the fourth embodiment, driving is performed with the same driving period as the normal driving, when scanning is performed by suppressing scanning signals in the MF driving method, while scanning is paused when the other lines display a standstill picture. However, this fifth embodiment is characterized by improving the ON-characteristic of a TFT by setting the driving period to be long when a standstill picture is displayed. In this case, the ON-characteristic is considered to be a significant problem caused when a moving picture is displayed. However, compared to a standstill picture, human eyes have less sensitivity to high spatial frequencies in a moving picture, so that shortage of writing does not cause low image quality.

In this case, since the time axis must be converted, improvements in the ON-characteristic can be realized by using a line memory or a frame memory to slowly read out a line with a time equal to or longer than that normally required for reading one line. Further, it is possible to uniformly assign driving periods by detecting the ratio of moving picture lines to standstill picture lines. Specifically, if a driving period Ts is decided so as to satisfy an equation:

$$Ts=Tf/(n+m)$$

where the number of all scanning lines which are scanned within a field is represented as n, the number of scanning lines which are part of an internal moving picture, except for those scanning lines which are scanned within the field, is represented as m, and one field period is Tf, the driving period can be ensured, regardless of whether a moving or standstill picture is displayed. In this state, there may be a method for simplifying the circuit system, e.g., by setting the period Ts to be an integer multiple of Tf/n.

FIG. 13 shows a case in which at least one of every three scanning lines is scanned and in which the scanning lines are scanned when a moving picture is displayed. In this case, lines N, N+3, N+6, . . . are scanned sequentially, and the line N is scanned with a scanning period as three times long as a normal scanning period since lines N+1 and N+2 are part of the standstill portion of picture. Specifically, control is carried out such that the horizontal clock frequency is ⅓ and the gate scanning period is elongated by three times. During the next scanning for N+3, two lines must be driven since the line N+4 is part of the moving portion of the picture.

In this embodiment, since deterioration of image quality is low even when the resolution of a moving picture is low, the scanning period is multiplied by two times for a standstill picture and by one time for a moving picture. Therefore, control is carried out such that the horizontal clock frequency is ½ and the gate scanning period is multiplied by two times for a standstill picture while both the horizontal clock frequency and the gate scanning period are unchanged from their normal values for a moving picture. However, as has been explained above, for both the standstill and moving pictures, the horizontal clock frequency may be reduced to ⅔ of its normal value and the gate scanning period may be multiplied by 1.5 times. The frequency and the period may further be changed by the driving polarities. In addition, there is a method of processing a moving picture as if it were a standstill picture, when the speed of a moving picture is low.

The next embodiment is designed to reduce the display speed by taking advantage of the visual characteristics of the eye of an observer. More specifically, the visual characteristics are degraded when the resolution of a moving picture within a separate window is lower than that of a standstill picture outside the window and when the visual characteristic is more degraded with respect to the resolution of a moving picture where a standstill image displayed on the entire display screen is compared with a moving picture displayed on the entire display screen. In the fifth embodiment, when a moving picture is displayed, driving is performed by non-interlacing. In the sixth embodiment, the power consumption can be reduced by decreasing the driving frequency for display as a result of simultaneously driving a number of scanning lines when a moving picture is displayed. For example, this example corresponds to a case where a moving picture of NTSC level is displayed, and in this state, two or four lines are simultaneously driven.

(Sixth Embodiment)

Figure 14:
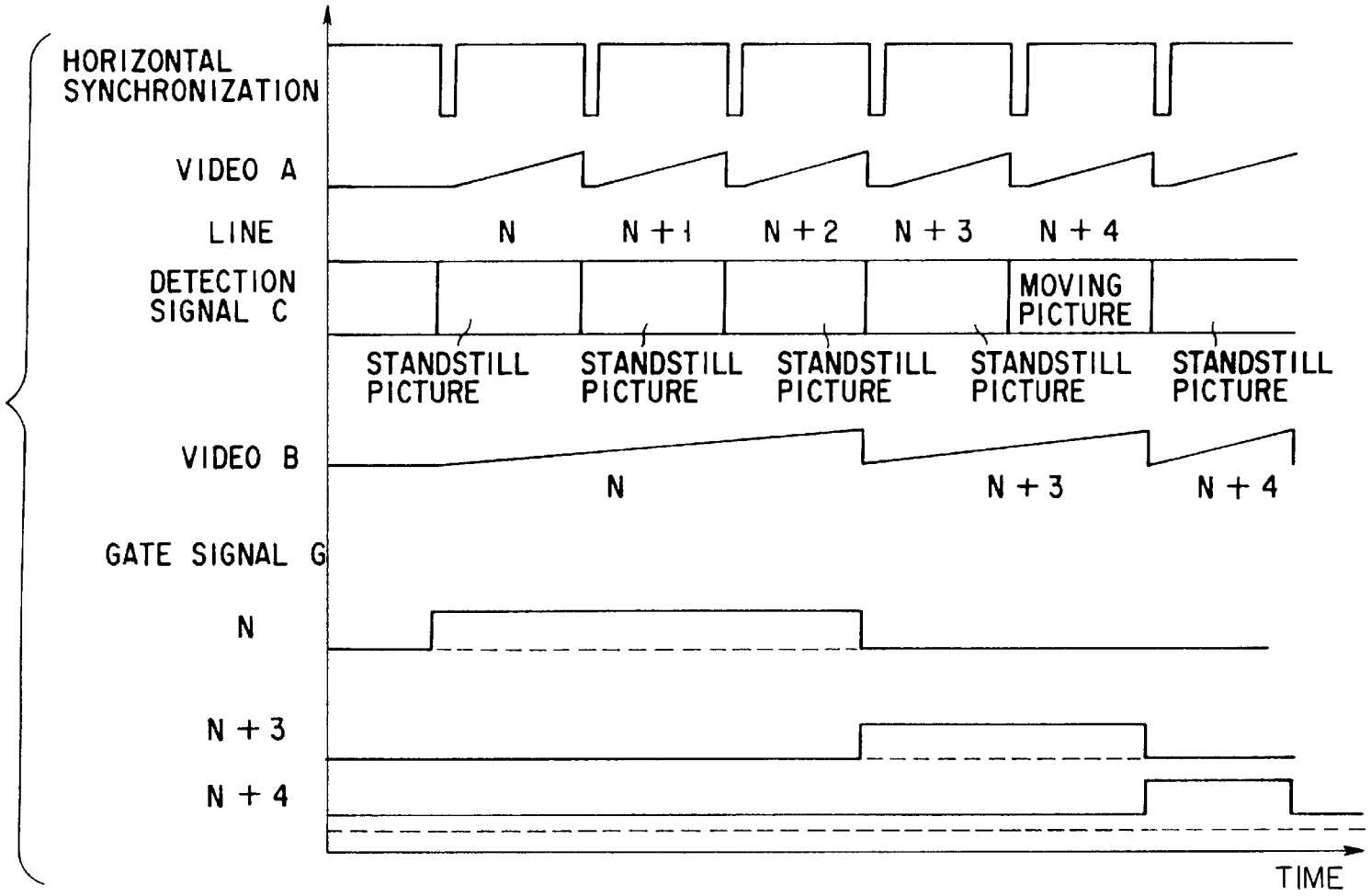
FIG. 14 is a timing chart showing driving voltages of gates in a sixth embodiment.

FIG. 14 shows voltages for driving gates and timing charts in the sixth embodiment of the present invention. In the above examples, the gate driving period is controlled. However, in this embodiment, where the driving period is reduced when a moving picture is displayed and the maintenance period of an image is increased when a standstill picture is displayed, it is considered important to control the ON-level and OFF-level of gates. Specifically, the gate voltage is raised when a moving picture is displayed (or when the ON-period is short), while the OFF level is lowered when a standstill picture is displayed (or when the maintenance period is long). This can be easily realized by controlling the voltage if the withstanding voltage of driving ICs is high. However, the power sources of the ICs must be switched when the voltage exceeds the withstanding voltage. The times when such changes are performed should desirably be within periods during which image signals are not outputted so that image signals are not influenced. In FIG. 14, the withstanding voltages are set to be sufficiently high with respect to lines n and N+3 of a standstill picture and a line N+4 of a moving picture, on the basis of the fifth embodiment, while the ON- and OFF-levels are changed without changing the amplitude. When the withstanding voltage of the driving ICs is not sufficiently high, the power source voltage of the ICs must be switched, depending on whether a moving picture or a standstill picture is displayed. In this case, even if the source voltage is switched or every line, the ICs which switch the source voltage have the switched source voltages, so that the maintenance characteristics or the ON-characteristics for the other lines need to be sacrificed. Note that if control is performed by completely separating a one-screen standstill picture mode and a moving picture mode from each other, the source voltage is switched for every one or more fields, so that sufficient advantages are attained when standstill and moving pictures are consecutively displayed.

Next, how the gate voltage should be controlled will be explained below. The present inventors found that line-like disturbance stripes flowed when the MF driving is actually carried out, using flicker amounts (i.e., minimum frequency spectra when the field frequency is merely reduced) of the normal driving as standards. However, it has been found that these disturbance stripes are more difficult to observe when the flicker amounts of the normal driving are somewhat low, rather than when the flicker amounts of the normal driving are lowest.

In the above embodiment, the gate voltage is controlled, depending on whether a standstill picture or a moving picture is displayed. However, this embodiment may be modified without deviating from the subject matter of the present invention, such as when the driving period must be made variable in accordance with, e.g., the leakage amount of light.

Figure 15:
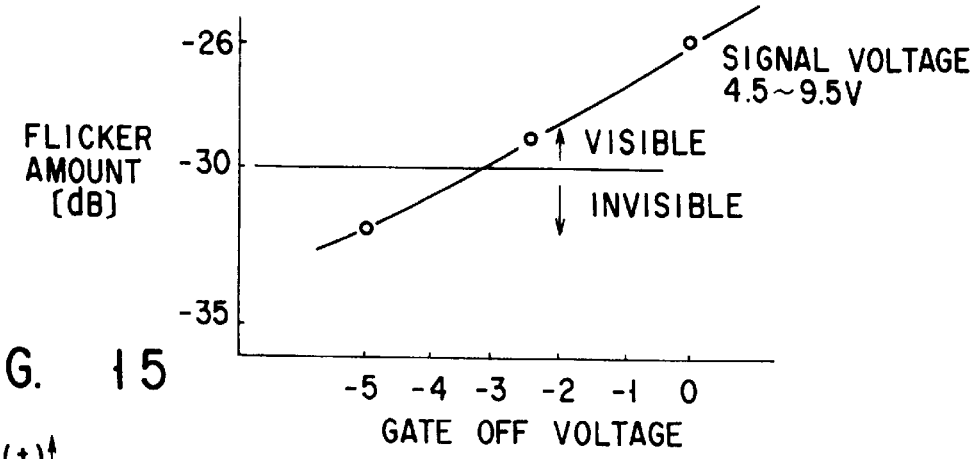
FIG. 15 is a graph showing a relationship between the flicker amount and the presence of disturbance stripes.

FIG. 15 shows a relationship as to whether or not the flicker amounts and line-like stripes can be detected. From this figure, it is apparent that the optimal value of the flicker amount with respect to an averaged luminance is obtained when the flicker amount is −30 dB or more. That is, when a line flicker is larger by some extent, the line flicker serves as noise so that line-like stripes cannot be recognized. On the contrary, when the line flicker is small, line-like stripes can be clearly observed and recognized. However, when the line flicker is much smaller to be −40 db or less, the stripes themselves cannot be observed. I is therefore effective to adopt a method of educing the voltage of gates to the OFF-characteristic, rather than increasing the flicker amount, if the OFF characteristics of the TFT or diodes can be improved.

In the above embodiment, although a control amount is automatically generated to make the ON- and OFF-levels variable, control terminals are placed outside an apparatus in this embodiment and are arranged to be manually variable. The voltage level of the gates cannot be changed from outside during normal driving. However, whether or not line-like stripes can be observed depends on differences between individual persons observing the display, on the number of the scanning lines which are scanned within one field, and on the external environment. Therefore, it is desirable to use a structure in which the ON- and OFF-levels can manually be changed from outside the apparatus. In addition, if a structure in which the number of scanning lines can be manually changed is use d, gate signals can be changed according to the changes in the number of the scanning lines. Since the present invention comprise s means for changing gate signals, circuits need not substantially be added by adopting the structure. Further, in case of a display apparatus which is used for the purpose of displaying only a standstill picture, the off-voltage should desirably be reduced to be lower than the optimal OFF-level of the gate voltage for a moving picture.

As has been explained above, according to the present invention, deterioration in the writing characteristic and in the maintenance characteristic of switching elements due to narrow dynamic ranges inherent to scanning signal driving ICs can be prevented by equivalently enlarging the dynamic ranges of the scanning signal driving circuits. As a result, in is possible to prevent deterioration of image quality such as sticking and flickers of display images and to prevent deterioration of liquid crystal, thereby providing a liquid crystal display apparatus with high quality images and a long life time. Further, the present invention is not restricted by the structure of display signal electrodes, the method of AC-converting display signals to be applied, and the contents of display signals, but the apparatus according to the invention is applicable to any kinds of active matrix type LCD as long as the active matrix type (TFD or TFT) LCD in which a switch is provided for each pixel uses scanning electrode driving ICs.

In addition, according to the present invention, it is possible to prevent artifacts, e.g., flickers, sticking, line-disturbances, reflected distortions, from being increased due to of-leakage currents when the maintenance period of a pixel switch such as a TFT is lengthened. It is further possible to change the characteristics from outside, so that characteristic changes caused by time, temperature changes, and differences in human visual perception with respect to line disturbances between individual persons can be compensated for. It is therefore possible to realize a liquid crystal display apparatus which ensures high image quality.

Further, by providing means for changing the maintenance period in accordance with leakage amount of light, the driving frequency can be reduced to an optimal value so that the power consumption can be lowered. Further, by deceasing the OFF-level of gates when a standstill picture is displayed, deterioration in image quality can be prevented even if the maintenance period is lengthened. The power consumption can thus be reduced and, in addition, writing can be performed at a high speed by increasing the ON-level when a moving picture is displayed.

(Seventh Embodiment)

Figure 20A:
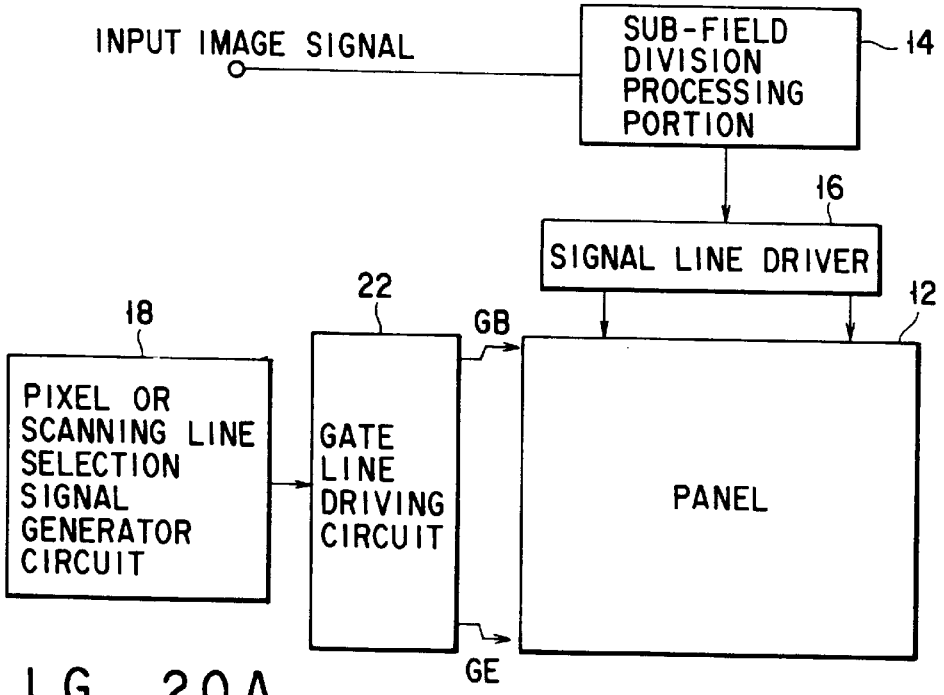
FIGS. 20A and 20B are diagrams showing the structure of a main part of the liquid crystal display apparatus according to the seventh embodiment of the present invention.
Figure 20B:
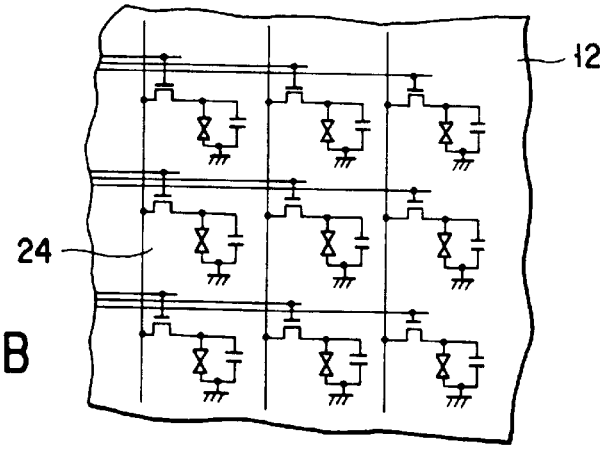

FIG. 20A shows the structure of a main portion of a liquid crystal display apparatus according to the seventh embodiment of the present invention. The seventh embodiment adopts an MF driving method described above of decreasing the driving frequency by dividing one frame (i.e., ore sheet of frame image) into a plurality of sub-fields (i.e., sub-images). The liquid crystal apparatus of this embodiment comprises a liquid crystal display panel 12, a sub-field division processing portion 14, a signal line driver 16, a pixel or scanning line selection signal generating circuit 18, and a gate line driving circuit 22, as shown in FIG. 20A. Cells 24 of the liquid crystal panel are constructed in a structure (e.g., a segment type display) in which a call can be selected for every pixel, as is shown in FIG. 20B, and therefore, the cells can operate effectively if the intervals between pixels respectively forming the sub-fields are irregularly changed, i.e., if the intervals between selected pixels are changed for every sub-field. Although the processing performed by the sub-field division processing portion 14 may include any steps, processing for reducing deterioration of a display image, which is considered to be a problem of prior art techniques, is included in this embodiment.

To achieve easy understanding, a driving method according to this embodiment will be explained with reference to an example of a case in which three of nine pixels are selected (i.e., the number of sub-fields is 9/3=3) as is shown in FIG. 21. At first, in the sub-field division processing portion 14, a pixel 26 is selected and three sub-fields SF11 to SF13 are formed. In FIG. 21, the portions indicated by oblique lines are selected pixels, and the white portions are non-selected pixels. In this case, image signals to be read out by the sub-field division processing portion 14 are reduced to ⅓ of the signal of a conventional apparatus. As is known from the MF driving method, the driving frequency can be reduced, so that the power consumption of the driving circuit 22, panel 12, and the signal driver 16 can be reduced. In addition, when pixel signals are respectively written into the pixels in the panel 12, a signal indicating the pixel which should be selected is sent from the pixel selection signal generator circuit 18 to the gate line driving circuit 22, and control is performed so that the gate lines corresponding to the respective pixels are turned on. The sub-field division processing portion 14 is designed for the purpose of preventing occurrences of a line disturbance, i.e., a factor which causes a reflected distortion, and the potion 14 functions most effectively by setting intervals of selected pixels into a regime of spatial frequency in which the eye cannot detect a line disturbance.

In the seventh embodiment, an explanation has been made of the case where the same number of pixels are selected for each sub-field so that pixel intervals irregularly change along the time axis. Various modifications can be made with respect to the number of selected pixels and the selection method. In addition, this embodiment is applicable to a case where a substantially equal number of scanning lines are selected for each sub-field so that intervals between scanning lines irregularly change along the time axis.

(Eight Embodiment)

FIG. 22A shows the structure of a main part of a liquid crystal display apparatus according to the eighth embodiment of the present invention. The eighth embodiment is a modified example of the seventh embodiment, and also adopts an MF driving method in which the driving frequency is reduced by dividing one frame (i.e., a frame image) into a plurality of sub-fields (i.e., sub-images). Since the multi-field driving method is well-known, detailed explanation thereof will be omitted herefrom. In particular, the liquid crystal apparatus of this embodiment comprises an n:m interlacing processing circuit 34 and a scanning selection signal generator circuit 38, as is shown in FIG. 22A. Furthermore, the liquid crystal apparatus of this embodiment comprises a liquid crystal display panel 32, a signal line driver 36, an n counter circuit 40, and a gate line driving circuit 42. The gate line driving circuit 42 has a structure as shown in FIG. 22B. The processing performed by the interlacing circuit 34 may include any steps, and in this embodiment, the processing is used to reduce deterioration of a display image, which is considered to be a problem of prior art techniques.

To obtain easy understanding, the driving method according to this embodiment will be explained with reference to an example in which n=6 and m=2 (the number of sub-fields is 6/2=3), as is shown in FIG. 23. At first, in the n:m interlacing processing circuit 34, a pixel corresponding to a scanning line 46 is selected as shown in FIG. 23, and three sub-fields SF21 to SF23 are formed. In FIG. 23, the portions indicated by oblique lines are selected pixels, and the white portions are non-selected pixels. In this case, image signals to be read out by the sub-field division processing portion 14 are reduced to ⅓ of the signals of a conventional apparatus. As is known from the MF driving method, the driving frequency can be reduced, so that the power consumption of the driving circuit 22, panel 12, and the signal driver 16 can be reduced. In addition, when image signals are written into the respective pixels in the panel 32, a signal (S1) indicating the pixel which should be selected is sent from the scanning line selection signal generator circuit 38 to a gate line driving circuit 42, and is processed between the signal (S1) and a signal obtained by shifting a signal (S2) sent from the n counter circuit 40. In this manner, control is performed so as to turn on gate lines corresponding to the pixels.

Figure 24:
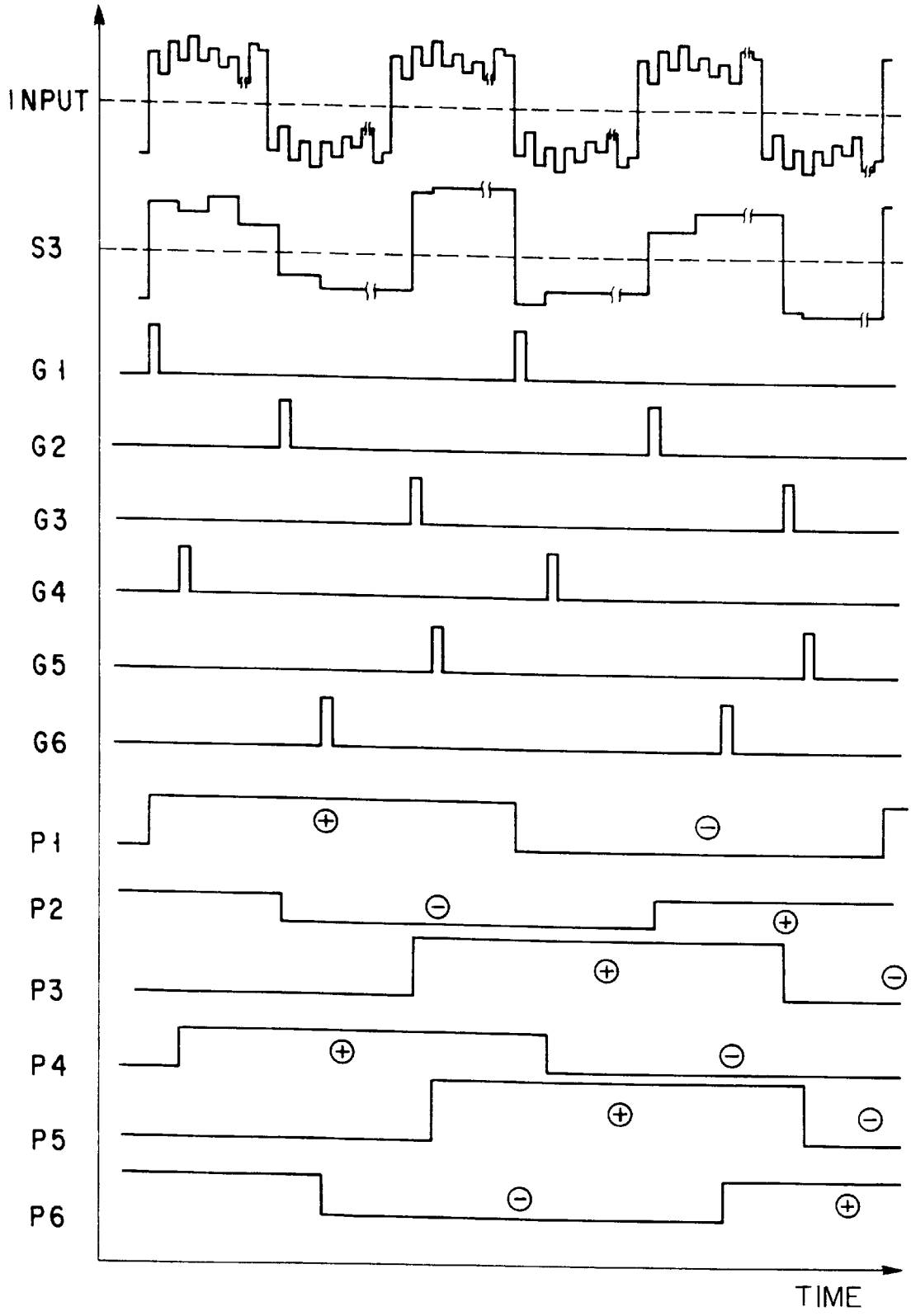
FIG. 24 is a timing chart showing driving signal voltages and timings in the driving method according to the eight embodiment of the present invention.

FIG. 24 shows signal waveforms corresponding to signal lines. In this figure, "INPUT", "S3", "Gn", "Pn" respectively denote voltages of an input image signal, a signal from a signal line driver 36 to a panel 32, ON/OFF states of gate lines, and pixels corresponding to scanning lines. Even if this n:m interlacing precessing is carried out, a line disturbance causing a reflected distortion is generated. However, as shown in FIG. 25A, intervals of line disturbances and a flow of lateral stripes, which occurs when scanning lines are sequentially scanned from an upper line to a lower line, are eliminated. Consequently, time-spatial spectra of line disturbances are diffused, making it difficult for the eye to observe such line disturbances, and it has been found from experimental tests that the method is effective for reflected distortions. Changes in luminance of pixels corresponding to scanning lines are shows in cases where the method of the present invention is used (FIG. 25A) and where a conventional MF driving method is used (FIG. 25B). In these figures, the luminance changes from bright to dark in the order of the portions indicated by white, oblique lines, and mesh lines, and the pixel voltage changes from low to high in this order.

Although the above explanation exemplifies a case in which input signals are interacted at a ratio of 6:2, signals can be changed to normal n:1 interlacing signals, n:m (m<n) interlacing signals, and other types of signals, as long as such modifications do not deviate from the subject matter of the present invention.

In the seventh and eighth embodiments, as a pixel selection method for forming sub-fields, it is desirable to use a method in which flickers are compensated for within one frame in order to improve image quality. Since line disturbances are caused by the maintenance characteristics of pixels, it is desirable to decide selection intervals of pixels or scanning lines such that line disturbances or reflected distortion do not occur with respect to an image signal of 10% level which easily generates a cross talk and to an image signal of 50% level which causes a rapid change in transmittance.

(Ninth Embodiment)

In the present invention, since an image is displayed by changing intervals of the pixels and/or scanning lines in accordance with inputted image signals, processing in an image signal input portion is required. Image signals of one frame are divided into a plurality of sub-fields, so that the pixels into which signals once have been written maintain images thus written during a non-selection period until signals are written again. Therefore, signals, for example, of a moving picture or the like, which require a sample frequency in the time axis direction, are not written even if signals having a luminance extremely different from that of signals when written are inputted during a non-selection period, so that the signals of such a moving picture appear as a residual image phenomenon.

Figure 26:
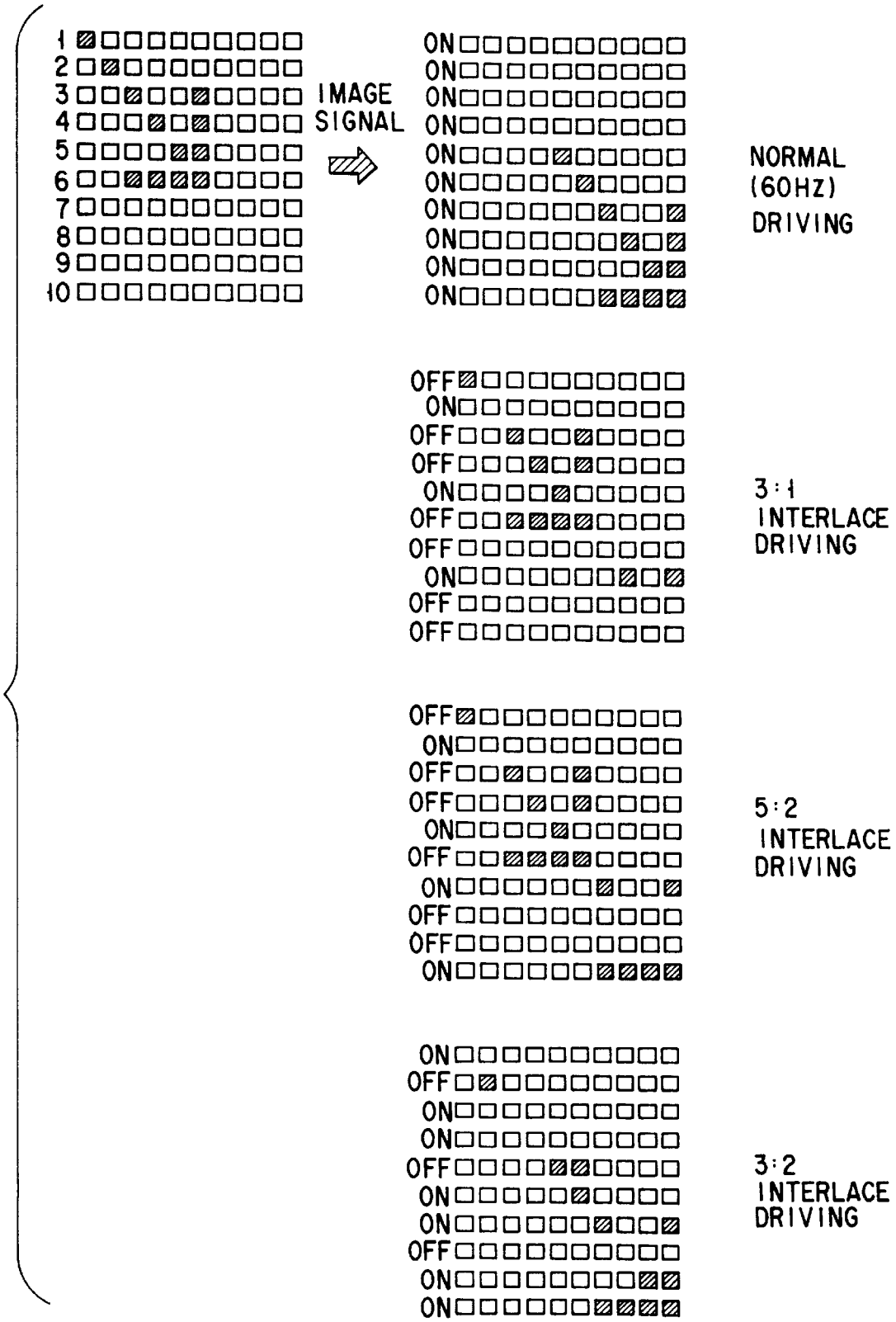
FIG. 26 shows display images when image signals are switched in a moving picture.

FIG. 26 shows residual image phenomena which occur with a cursor such as a mouse, with respect to 3:1, 5:2, 3:2 interlace driving methods. When the apparatus is driven by the 3:1 interlace driving method, there may be residual images and new images do not substantially appear. When the apparatus is driven by the 5:2 interlace driving method, both residual and new images appear. Further, in the 3:2 interlace driving method, few residual images appear and many new images appear. Changes in the image signals caused by increasing the number of sub-fields within one frame are remarkable.

Figure 27:
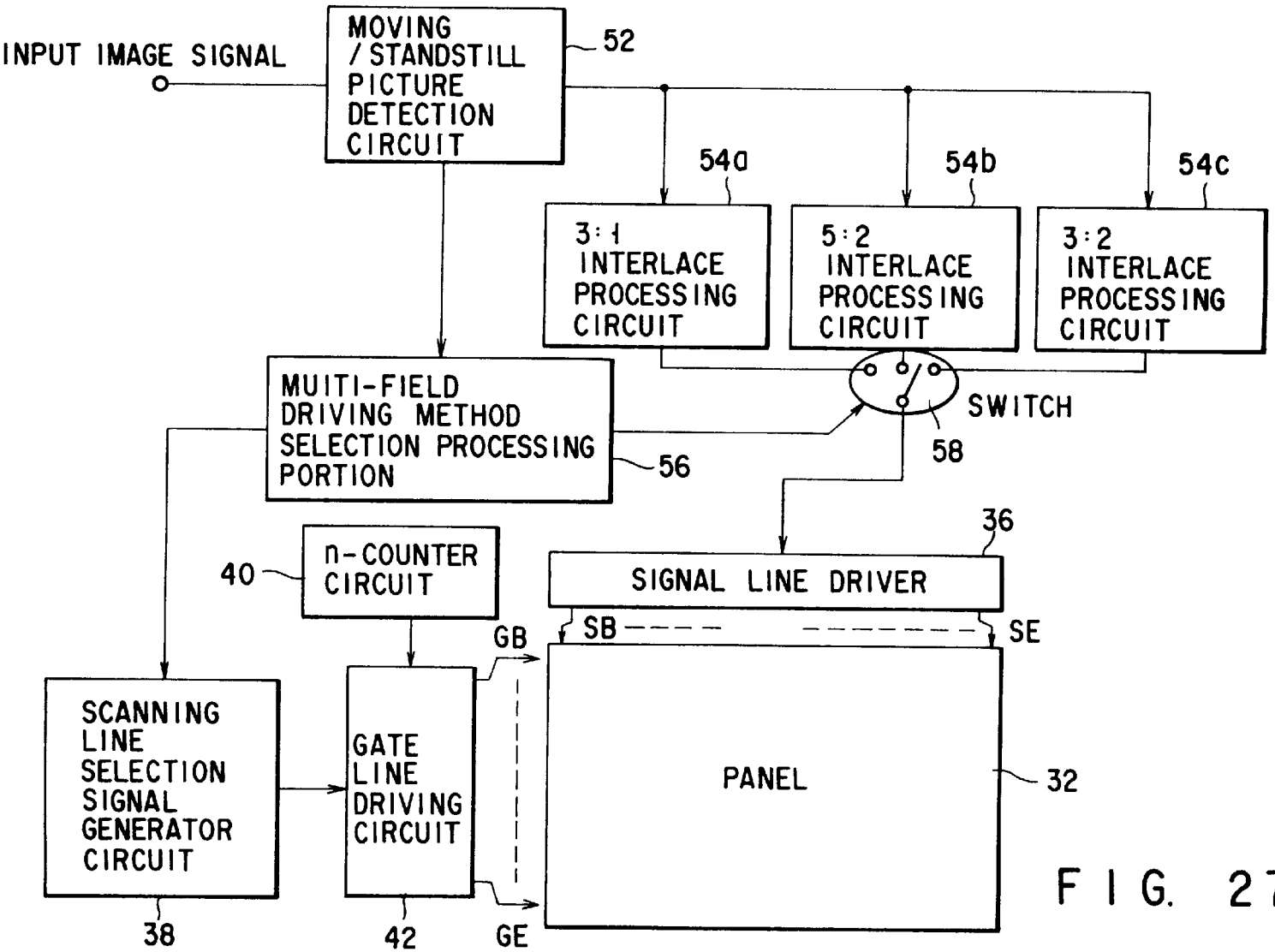
FIG. 27 is a block diagram showing the structure of a main part of a liquid crystal display apparatus according to the ninth embodiment of the present invention.

FIG. 27 shows the structure of a main part of a liquid crystal display apparatus according to the ninth embodiment of the present invention. The liquid crystal apparatus of this embodiment differs from that of the second embodiment shown in FIG. 22A in that the apparatus of the ninth embodiment comprises a moving/standstill detection processing portion 52, three interlace processing circuits 54*a*, 54*b*, and 54*c* which are connected to the portion 52 and respectively have ratios of n:m=3:1, 5:2, and 3:2, an MF driving method selection processing portion 56, and a switch 58 for switching the interlace processing circuits 54*a*, 54*b*, and 54*c*. In each of the n:m interlace driving methods, the scanning lines may be arranged such that the intervals irregularly change as has been explained in the second embodiment.

(Tenth Embodiment)

Figure 28:
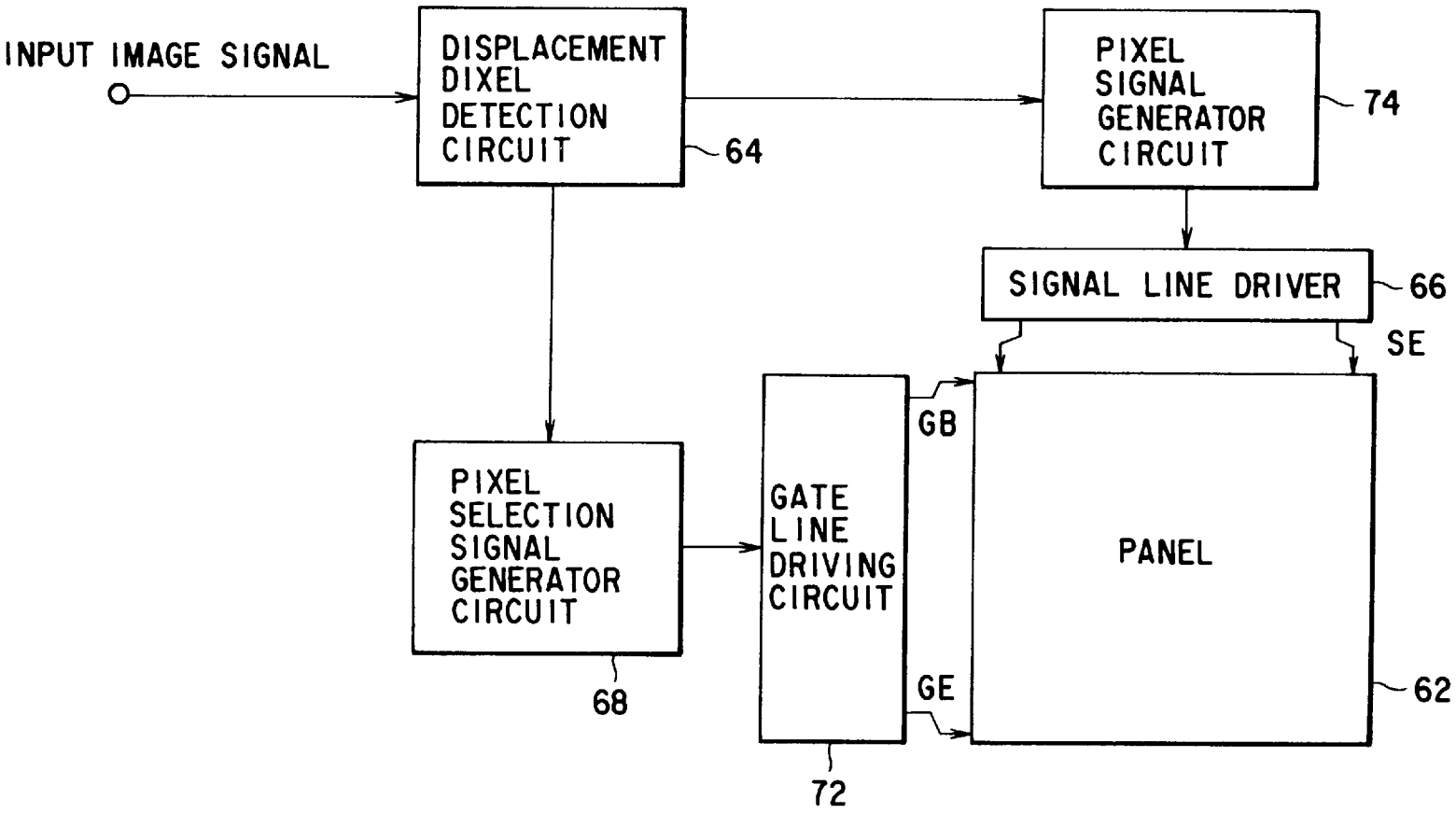
FIG. 28 is a block diagram showing the structure of a main part of a liquid crystal display apparatus according to the tenth embodiment of the present invention.

FIG. 28 shows the structure of a main part of the liquid crystal display apparatus according to the tenth embodiment of the present invention. The apparatus according to the present invention has a requisite of having a basic structure for performing MF driving. An explanation of the structure required for performing the MF driving will be omitted herefrom to avoid reiteration of the same explanation made to the seventh embodiment. The liquid crystal apparatus according to this embodiment comprises a liquid crystal panel 62, a signal line driver 66, a pixel selection signal generator circuit 68, and a gate line driving circuit 72, and additionally comprises a displacement pixel detection circuit 64 and a pixel signal generator circuit 74. Cells of the liquid crystal display panel are constructed in a structure (e.g., a structure of a segment type display) in which a cell can be selected for each pixel. The displacement detection circuit 62 detects displacement pixels, which correspond to signals which are different between a preceding frame and a next frame. In response to detection of those signals, the pixel signal generator circuit 74 outputs changed image signals and the pixel selection signal generator circuit 68 selects pixels. In other words, only displacement pixels are selected and writing is performed. Therefore, signals of a preceding frame are recorded in a frame memory, and selection or non-selection of signals is decided depending on interrelation between the recorded signals and signals of the next frame. Since residual images are caused by differences in luminance between a preceding frame and a next frame, only high level bits of gradation signals or pixels which summarize the high level bits may be sub-sampled and used as references for selection. In this manner, the signal processing system can be realized with a simplified structure. For example, with respect to image signals consisting of 4-bit gradation signals, high level 2-bit is used as a selection reference, and image signals of L are selected, when the frame preceding the bit includes signals of H and all the signals of H are also included in the next frame. In addition, taking into consideration the maintenance characteristic of pixels, there may be provided means for supplemental writing into those pixels on which writing is not yet performed for several frames, in order to compensate for unevenness in luminance.

In the above explanation, the tenth embodiment is described as being designed to detect displacement pixels. For example, as in the first embodiment, this embodiment is applicable o a structure in which cells of the liquid crystal panel can be selected for each pixel. In displacement scanning lines are detected in place of displacement pixels, this embodiment can be applied to n:m interlace driving as explained in the eighth and ninth embodiments. Thus, the tenth embodiment is applicable to any MF methods (including conventional methods) in which selection and non-selection pixels (or scanning lines) occur.

(Eleventh Embodiment)

Figure 29:
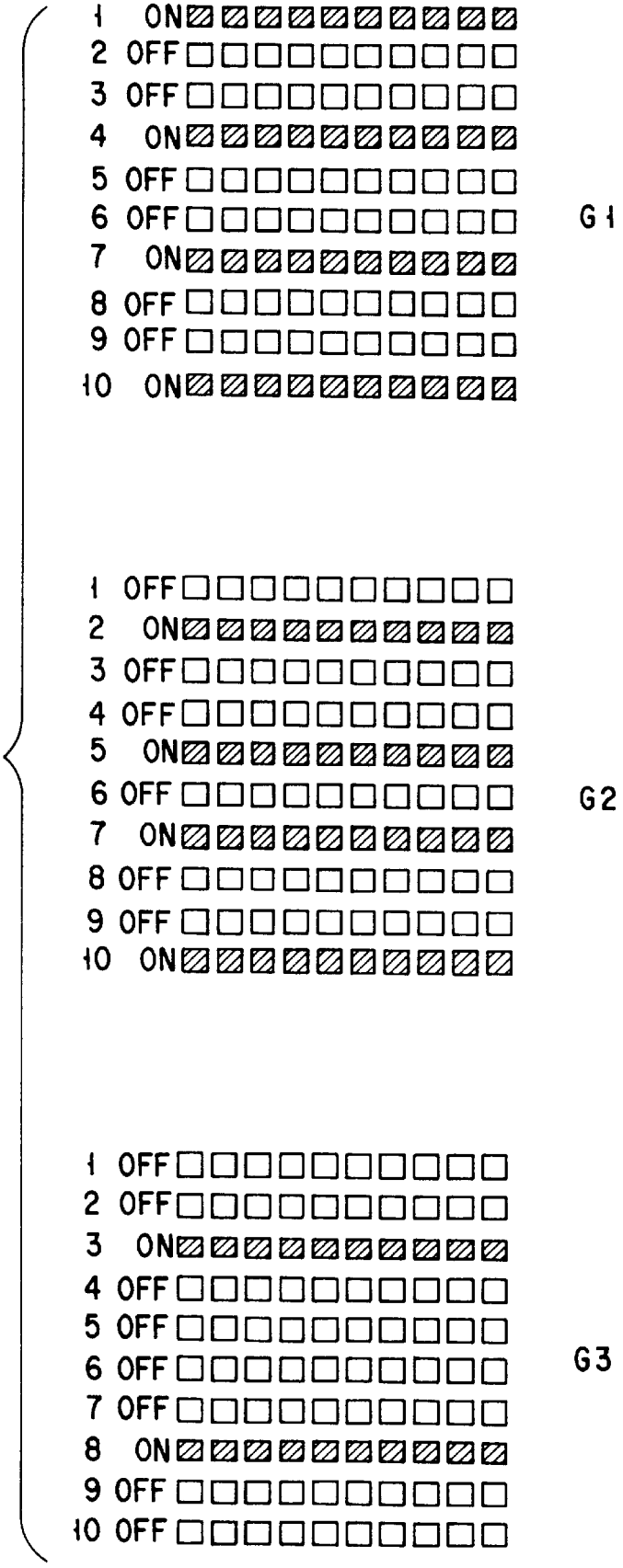
FIG. 29 shows sub-fields of the driving method according to the eleventh embodiment of the present intention.

The liquid crystal display apparatus according to the fifth embodiment is characterized in that the ratio of n:m is changed for each group consisting of a plurality of sub-fields in the structure of the liquid crystal display apparatus of FIG. 20A explained in the seventh embodiment. For example, as shown in FIG. 29, in a first group GI consisting of X sub-fields, one of three scanning lines is driven (i.e., a ratio of 3:1), and in a second group G2 consisting of the next Y sub-fields, two of five scanning lines are driven (i.e., a ratio of 5:2). In a third group G3 consisting of next Z sub-fields, one of five scanning lines is driven (i.e., a ratio of 5:1). Here, X, Y, and Z are respectively multiples of 3, 5, and 5 which correspond to n of the ratio n:m. The number of sub-fields in one group may be changed or may be the same for each group. In each of n:m interlace driving, scanning lines may be arranged such that intervals irregularly change as in the eighth embodiment or such that intervals regularly change as in a conventional MF driving method. Note that intervals may be changed in units of pixels, although the above examples deal with cases in which intervals are changed in units of scanning lines.

According to this embodiment, the interval between pixels or scanning lines is switched for each group of sub-fields for cases of image signals which would readily allow flickers to occur if driving were performed at a predetermined interval between pixels or scanning lines. Therefore, occurrence patterns of flickers can be changed for every group, making it difficult to observe flickers. In addition, it is considered that, as a result of thus switching the interval, surface flickers may be caused due to changes in luminance on the screen. However, surface flickers can be prevented from becoming a problem if the surface flickers are arranged to have a low time frequency and a low contrast, thus insuring that the surface flickers cannot be observed, in light of the time-spatial characteristics of human visual perception. In order to compensate for the surface flickers, if the structure includes a function for detecting average luminance on the screen before switching and feed-back is performed, changes in luminance can be prevented from occurring when switching is performed. FIG. 11 shows the structure of a main part of a liquid crystal display apparatus for realizing the above structure.

Figure 30:
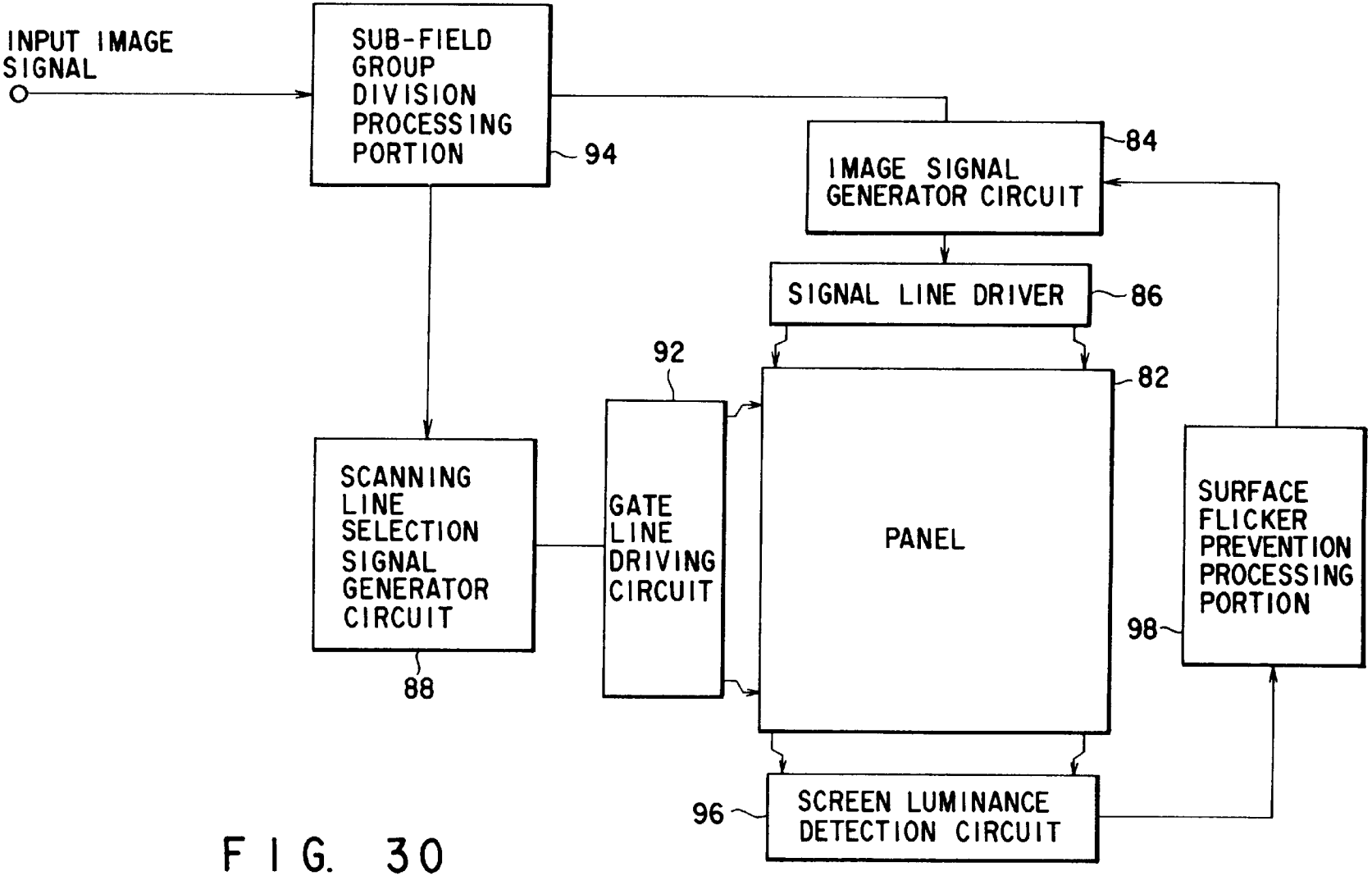
FIG. 30 is a block diagram showing the structure of a main part of a liquid crystal display apparatus according to the eleventh embodiment of the present invention.

FIG. 30 is a block diagram showing the structure of a main part of a liquid crystal display apparatus according to the eleventh embodiment of the present invention. The liquid crystal display apparatus according to the eleventh embodiment comprises a liquid crystal panel 82, a signal line driver 86, a scanning line selection signal generator circuit 88, and a gate line driving circuit 92. A sub-field group division processing portion 94 for grouping sub-fields is connected to the signal line driver 86 through an image signal generator circuit 84. In addition, to compensate for surface flickers, a screen luminance detection circuit 96 is connected to the panel 82. The screen luminance detection circuit 96 detects voltages applied to pixels of a preceding sub-field during a blanking period, and information concerning the voltages is processed through a surface flicker prevention processing portion 98 so that feed-back modifies the image signals of the next field.

In the explanation of the above eleventh embodiment, grouping of sub-fields is performed, regardless of units of frame images. However, grouping of sub-fields may be arranged so as to comply with units of frame images such that each group consists of one frame or a plurality of frames. The number of frames may be equal to each other for each group or may differ between groups. In this manner, the interval between pixels or scanning lines is switched for each group of sub-fields for cases of image signals which would readily allow flickers to occur if driving were performed at a predetermined interval between pixels or lines. Therefore, patterns of flickers are difficult to observe.

According to the present invention, intervals between pixels or scanning lines are changed for every sub-field and the intervals are irregularly changed along the time axis, thereby making it difficult to observe luminance changes of pixels or scanning lines. Further, reflected distortions are difficult to observed so that deterioration of image quality can be greatly reduced. In addition, according to the present invention, since the value of m/n, i.e., the density of pixels or scanning lines in a sub-field, is changed, depending on image signals, it is possible to maintain required image quality even when the driving frequency is decreased. Further, according to the present invention, since the value of m/n is changed for every one of a set of groups divided along the time axis, patterns of flickers change for every group, thereby making it difficult to observe flickers. In addition, according to the present invention, since additional writing is selectively performed on displacement pixels or scanning lines, a residual image caused by a difference in luminance can be for example, eliminated.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A driving method used in a display apparatus for displaying an image by means of A pixels or pieces of scanning lines which are respectively provided with selection switch elements, the method comprising the steps of:

dividing a sheet of frame image into n sub-fields which are displayed sequentially along a time axis, each of the sub-fields being basically formed of A/n×m pixels or pieces of the scanning lines (where A is a positive integer, n is a positive integer which is equal to 3 or more and is equal to A or less, and m is a positive integer equal to n or less); and a step of changing one of an interval between pixels of a sub-field and an interval between scanning lines of a sub-field.

2. A driving method according to claim 1, said method further comprising:

determining a first interval, said first interval being one of an interval between pixels of a first sub-field and an interval between scanning lines of said first sub-field;

determining a second interval, said second interval being one of an interval between pixels of a second sub-field and an interval between scanning lines of said second sub-field;

changing a selected one of said first and second intervals to differ from an other one of said first and second intervals, wherein said selected one is changed irregularly along a time axis.

3. A driving method used in a display apparatus for displaying an image by means of A pixels or pieces of scanning lines which are respectively provided with selection switch elements, the method comprising the steps of:

dividing a sheet of frame image into n sub-fields which are displayed sequentially along a time axis, each of the sub-fields being basically formed of A/n×m pixels or pieces of the scanning lines (where A is a positive integer, n is a positive integer which is equal to 3 or more and is equal to A or less, and m is a positive integer equal to n or less); and changing numerical values of m and n depending on image signals of the frame image.

4. A driving method according to claim 3, said method further comprising:

determining a first interval, said first interval being one of an interval between pixels of a first sub-field and an interval between scanning lines of said first sub-field;

determining a second interval, said second interval being one of an interval between pixels of a second sub-field and an interval between scanning lines of said second sub-field;

changing a selected one of said first and second intervals to differ from an other one of said first and second intervals, wherein said selected one is changed irregularly along a time axis.

5. A driving method used in a display apparatus for displaying an image by means of A pixels or pieces of scanning lines which are respectively provided with selection switch elements, the method comprising the steps of:

dividing a sheet of frame image into n sub-fields which are displayed sequentially along a time axis, each of the sub-fields being basically formed of A/n×m pixels or pieces of the scanning lines (where A is a positive integer, n is a positive integer which is equal to 3 or more and is equal to A or less, and m is a positive integer equal to n or less); and grouping the sub-fields along the time-axis, so that) numerical values of m and n differ between groups of the sub-fields.

6. A driving method according to claim 5, said method further comprising:

determining a first interval, said first interval being one of an interval between pixels of a first sub-field and an interval between scanning lines of said first sub-field;

determining a second interval, said second interval being one of an interval between pixels of a second sub-field and an interval between scanning lines of said second sub-field;

changing a selected one of said first and second intervals to differ from an other one of said first and second intervals, wherein said selected one is changed irregularly along a time axis.

7. A driving method used in a display apparatus for displaying an image by means of A pixels or pieces of scanning lines which are respectively provided with selection switch elements, the method comprising the steps of:

dividing a sheet of frame image into n sub-fields which are displayed sequentially along a time axis, each of the sub-fields being basically formed of A/n×m pixels or pieces of the scanning lines (where A is a positive integer, n is a positive integer which is equal to 3 or more and is equal to A or less, and m is a positive integer equal to n or less);

displaying a first sub-field;

selectively applying driving signals to displacement pixels or scanning lines wherein said displacement pixels or scanning lines do not belong to said first sub-field, and wherein said displacement pixels or scanning lines belong to a second sub-field, wherein a substantial portion of pixels of said second sub-field are not displayed.

8. A driving method according to claim 7, said method further comprising:

determining a first interval, said first interval being one of an interval between pixels of a first sub-field and an interval between scanning lines of said first sub-field;

determining a second interval, said second interval being one of an interval between pixels of a second sub-field and an interval between scanning lines of said second sub-field;

changing a selected one of said first and second intervals to differ from an other one of said first and second intervals, wherein said selected one is changed irregularly along a time axis.

* * * * *